US011122357B2

(12) United States Patent
Burnett

(10) Patent No.: US 11,122,357 B2
(45) **Date of Patent: *Sep. 14, 2021**

(54) FORMING VIRTUAL MICROPHONE ARRAYS USING DUAL OMNIDIRECTIONAL MICROPHONE ARRAY (DOMA)

(71) Applicant: Jawbone Innovations, LLC, Marshall, TX (US)

(72) Inventor: Gregory C. Burnett, Dodge Center, MN (US)

(73) Assignee: Jawbone Innovations, LLC, Marshall, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/959,708

(22) Filed: Aug. 5, 2013

(65) Prior Publication Data

US 2014/0185825 A1 Jul. 3, 2014

Related U.S. Application Data

(63) Continuation of application No. 12/139,333, filed on Jun. 13, 2008, now Pat. No. 8,503,691.
(Continued)

(51) Int. Cl.
*H04R 3/00* (2006.01)
*H04R 1/10* (2006.01)
(Continued)

(52) U.S. Cl.
CPC ..... *H04R 1/1091* (2013.01); *G10L 21/0208* (2013.01); *H04R 1/406* (2013.01);
(Continued)

(58) Field of Classification Search
CPC .... H04R 3/005; H04R 2410/05; H04R 3/002; H04R 3/04; H04R 1/1091; H04R 1/406;
(Continued)

(56) References Cited

U.S. PATENT DOCUMENTS 4,653,102 A 3/1987 Hansen
4,777,649 A 10/1988 Carlson et al.
(Continued)

FOREIGN PATENT DOCUMENTS

WO 2009003180 12/2008

OTHER PUBLICATIONS

Weiss, Howard; Office Action mailed by U.S. Patent and Trademark Office dated Apr. 10, 2012 for U.S. Appl. No. 12/139,333.
(Continued)

*Primary Examiner* — Marcos D. Pizarro
(74) *Attorney, Agent, or Firm* — Nutter McClennen & Fish LLP

(57) ABSTRACT

A dual omnidirectional microphone array noise suppression is described. Compared to conventional arrays and algorithms, which seek to reduce noise by nulling out noise sources, the array of an embodiment is used to form two distinct virtual directional microphones which are configured to have very similar noise responses and very dissimilar speech responses. The only null formed is one used to remove the speech of the user from $V_2$. The two virtual microphones may be paired with an adaptive filter algorithm and VAD algorithm to significantly reduce the noise without distorting the speech, significantly improving the SNR of the desired speech over conventional noise suppression systems.

20 Claims, 17 Drawing Sheets

Related U.S. Application Data

(60) Provisional application No. 60/934,551, filed on Jun. 13, 2007, provisional application No. 60/953,444, filed on Aug. 1, 2007, provisional application No. 60/954,712, filed on Aug. 8, 2007, provisional application No. 61/045,377, filed on Apr. 16, 2008.

(51) Int. Cl.
*G10L 21/0208* (2013.01)
*H04R 1/40* (2006.01)
*H04R 3/04* (2006.01)
*G10L 21/0216* (2013.01)

(52) U.S. Cl.
CPC ..... *H04R 3/002* (2013.01); *H04R 3/005* (2013.01); *H04R 3/04* (2013.01); *G10L 2021/02165* (2013.01); *H04R 2460/01* (2013.01)

(58) Field of Classification Search
CPC ..... H04R 2460/01; G10L 2021/02165; G10L 21/0208
USPC ..... 381/92, 94.7; 704/233, E21.004
See application file for complete search history.

(56) References Cited

U.S. PATENT DOCUMENTS

| | | | | |
|---|---|---|---|---|
| 5,208,864 | A | 5/1993 | Kaneda | |
| 5,276,765 | A | 1/1994 | Freeman et al. | |
| 5,353,376 | A | 10/1994 | Oh et al. | |
| 5,406,622 | A | 4/1995 | Silverberg et al. | |
| 5,463,694 | A | 10/1995 | Bradely et al. | |
| 5,473,701 | A | 12/1995 | Cezanne et al. | |
| 5,473,702 | A | 12/1995 | Yoshida et al. | |
| 5,517,435 | A | 5/1996 | Sugiyama | |
| 5,590,241 | A | 12/1996 | Park et al. | |
| 5,625,684 | A | 4/1997 | Matouk et al. | |
| 5,633,935 | A | 5/1997 | Kanamori et al. | |
| 5,664,014 | A | 9/1997 | Yamaguchi et al. | |
| 5,664,052 | A | 9/1997 | Nishiguchi et al. | |
| 5,729,694 | A | 3/1998 | Holzrichter et al. | |
| 5,754,665 | A | 5/1998 | Hosoi | |
| 5,815,582 | A | 9/1998 | Claybaugh et al. | |
| 5,825,897 | A | 10/1998 | Andrea et al. | |
| 5,907,624 | A | 5/1999 | Takada | |
| 6,006,175 | A | 12/1999 | Holzrichter | |
| 6,233,551 | B1 | 5/2001 | Cho et al. | |
| 6,707,910 | B1 | 3/2004 | Valve et al. | |
| 6,795,713 | B2 | 9/2004 | Housni | |
| 6,963,649 | B2 | 11/2005 | Vaudrey et al. | |
| 6,980,092 | B2 | 12/2005 | Turnbull et al. | |
| 7,206,418 | B2 | 4/2007 | Yang et al. | |
| 7,386,135 | B2 | 6/2008 | Fan | |
| 8,068,619 | B2 * | 11/2011 | Zhang et al. | 381/92 |
| 8,494,177 | B2 * | 7/2013 | Burnett | 381/92 |
| 8,503,691 | B2 * | 8/2013 | Burnett | 381/92 |
| 9,099,094 | B2 | 8/2015 | Burnett | |
| 2002/0110256 | A1 | 8/2002 | Watson et al. | |
| 2002/0116187 | A1 | 8/2002 | Erte | |
| 2003/0044025 | A1 | 3/2003 | Ouyang et al. | |
| 2003/0228023 | A1 | 12/2003 | Burnett et al. | |
| 2007/0003082 | A1 | 1/2007 | Pedersen | |
| 2007/0121974 | A1 | 5/2007 | Nemirovski | |
| 2009/0010450 | A1 | 1/2009 | Burnett | |

OTHER PUBLICATIONS

Weiss, Howard; Office Action mailed by U.S. Patent and Trademark Office dated Jul. 14, 2011 for U.S. Appl. No. 12/139,333.
Copenheaver, Blaine R; International Searching Authority; Notification of Transmittal of the International Search Report and Written Opinion of the International Searching Authority of the Declaration for International Patent Application No. PCT/US2008/068634, dated Sep. 2, 2008.
Tran, Long K.; Office Action mailed by U.S. Patent and Trademark Office dated Aug. 10, 2011 for U.S. Appl. No. 12/163,592.
Shah, Paras D.; Office Action mailed by U.S. Patent and Trademark Office dated Nov. 16, 2011 for U.S. Appl. No. 11/805,987.
Shah, Paras D.; Office Action mailed by U.S. Patent and Trademark Office dated Jan. 16, 2009 for U.S. Appl. No. 11/805,987.
Azad, Abul K..; Office Action mailed by U.S. Patent and Trademark Office dated Feb. 6, 2008 for U.S. Appl. No. 11/805,987.
Shah, Paras D.; Office Action mailed by U.S. Patent and Trademark Office dated Oct. 10, 2006 for U.S. Appl. No. 10/159,770.
Shah, Paras D.; Office Action mailed by U.S. Patent and Trademark Office dated Dec. 15, 2005 for U.S. Appl. No. 10/159,770.
Tran, Long K.; Office Action mailed by U.S. Patent and Trademark Office dated Jul. 31, 2013 for U.S. Appl. No. 13/436,765.
Lao, Lun S..; Office Action mailed by U.S. Patent and Trademark Office dated Aug. 30, 2010 for U.S. Appl. No. 10/667,207.
Lao, Lun S..; Office Action mailed by U.S. Patent and Trademark Office dated Dec. 24, 2009 for U.S. Appl. No. 10/667,207.
Lao, Lun S..; Office Action mailed by U.S. Patent and Trademark Office dated Mar. 11, 2009 for U.S. Appl. No. 10/667,207.
Lao, Lun S..; Office Action mailed by U.S. Patent and Trademark Office dated Jul. 9, 2008 for U.S. Appl. No. 10/667,207.
Lao, Lun S..; Office Action mailed by U.S. Patent and Trademark Office dated Feb. 9, 2007 for U.S. Appl. No. 10/667,207.
Tran, Long K.; Office Action mailed by U.S. Patent and Trademark Office dated Mar. 3, 2016 for U.S. Appl. No. 14/224,868.
Tran, Long K.; Office Action mailed by U.S. Patent and Trademark Office dated Aug. 7, 2015 for U.S. Appl. No. 14/224,868.
Tran, Long K.; Office Action mailed by U.S. Patent and Trademark Office dated Dec. 21, 2014 for U.S. Appl. No. 14/224,868.
Faulk, Devona E.; Office Action mailed by U.S. Patent and Trademark Office dated Mar. 3, 2016 for U.S. Appl. No. 10/400,282.
Faulk, Devona E.; Office Action mailed by U.S. Patent and Trademark Office dated Jun. 23, 2011 for U.S. Appl. No. 10/400,282.
Faulk, Devona E.; Office Action mailed by U.S. Patent and Trademark Office dated Aug. 17, 2010 for U.S. Appl. No. 10/400,282.
Faulk, Devona E.; Office Action mailed by U.S. Patent and Trademark Office dated Dec. 9, 2009 for U.S. Appl. No. 10/400,282.
Faulk, Devona E.; Office Action mailed by U.S. Patent and Trademark Office dated Mar. 16, 2009 for U.S. Appl. No. 10/400,282.
Faulk, Devona E.; Office Action mailed by U.S. Patent and Trademark Office dated Aug. 18, 2008 for U.S. Appl. No. 10/400,282.

* cited by examiner

FORMING VIRTUAL MICROPHONE ARRAYS USING DUAL OMNIDIRECTIONAL MICROPHONE ARRAY (DOMA)

CROSS-REFERENCE TO RELATED APPLICATIONS

This application is a continuation of U.S. Nonprovisional patent application Ser. No. 12/139,333, filed Jun. 13, 2008, now U.S. Pat. No. 8,503,691, entitled "Forming Virtual Microphone Arrays Using Dual Omnidirectional Microphone Array (DOMA)," which claims the benefit of U.S. Provisional Patent Application No. 60/934,551, filed Jun. 13, 2007, U.S. Provisional Patent Application No. 60/953,444, filed Aug. 1, 2007, U.S. Provisional Patent Application No. 60/954,712, filed Aug. 8, 2007, and U.S. Provisional Patent Application No. 61/045,377, filed Apr. 16, 2008, all of which are incorporated by reference herein in their entirety for all purposes.

TECHNICAL FIELD

The disclosure herein relates generally to noise suppression. In particular, this disclosure relates to noise suppression systems, devices, and methods for use in acoustic applications.

BACKGROUND

Conventional adaptive noise suppression algorithms have been around for some time. These conventional algorithms have used two or more microphones to sample both an (unwanted) acoustic noise field and the (desired) speech of a user. 20 The noise relationship between the microphones is then determined using an adaptive filter (such as Least-Mean-Squares as described in Haykin & Widrow, ISBN#0471215708, Wiley, 2002, but any adaptive or stationary system identification algorithm may be used) and that relationship used to filter the noise from the desired signal.

Most conventional noise suppression systems currently in use for speech communication systems are based on a single-microphone spectral subtraction technique first develop in the 1970's and described, for example, by S. F. Boll in "Suppression of Acoustic Noise in Speech using Spectral Subtraction," IEEE Trans. on ASSP, pp. 113-120, 1979. These techniques have been refined over the years, 30 but the basic principles of operation have remained the same. See, for example, U.S. Pat. No. 5,687,243 of McLaughlin, et al., and U.S. Pat. No. 4,811,404 of Vilmur, et al. There have also been several attempts at multi-microphone noise suppression systems, such as those outlined in U.S. Pat. No. 5,406,622 of Silverberg et al. and U.S. Pat. No. 5,463,694 of Bradley et al. Multi-microphone systems have not been very successful for a variety of reasons, the most compelling being poor noise cancellation performance and/or significant speech distortion. Primarily, conventional multi-microphone systems attempt to increase the SNR of the user's speech by "steering" the nulls of the system to the strongest noise sources. This approach is limited in the number of noise sources removed by the number of available nulls.

The Jawbone earpiece (referred to as the "Jawbone), introduced in December 2006 by AliphCom of San Francisco, Calif., was the first known commercial 10 product to use a pair of physical directional microphones (instead of omnidirectional microphones) to reduce environmental acoustic noise. The technology supporting the Jawbone is currently described under one or more of U.S. Pat. No. 7,246,058 by Burnett and/or U.S. patent application Ser. Nos. 10/400,282, 10/667,207, and/or 10/769,302. Generally, multi-microphone techniques make use of an acoustic-based Voice Activity Detector (VAD) to determine the background noise characteristics, where "voice" is generally understood to include human voiced speech, unvoiced speech, or a combination of voiced and unvoiced speech. The Jawbone improved on this by using a microphone-based sensor to construct a VAD signal using directly detected speech vibrations in the user's cheek. This allowed the Jawbone to aggressively remove noise when the user was not producing speech. However, the Jawbone uses a directional microphone array.

INCORPORATION BY REFERENCE

Each patent, patent application, and/or publication mentioned in this specification is herein incorporated by reference in its entirety to the same extent as if each individual patent, patent application, and/or publication was specifically and individually indicated to be incorporated by reference.

SUMMARY OF THE INVENTION

Figure 1:
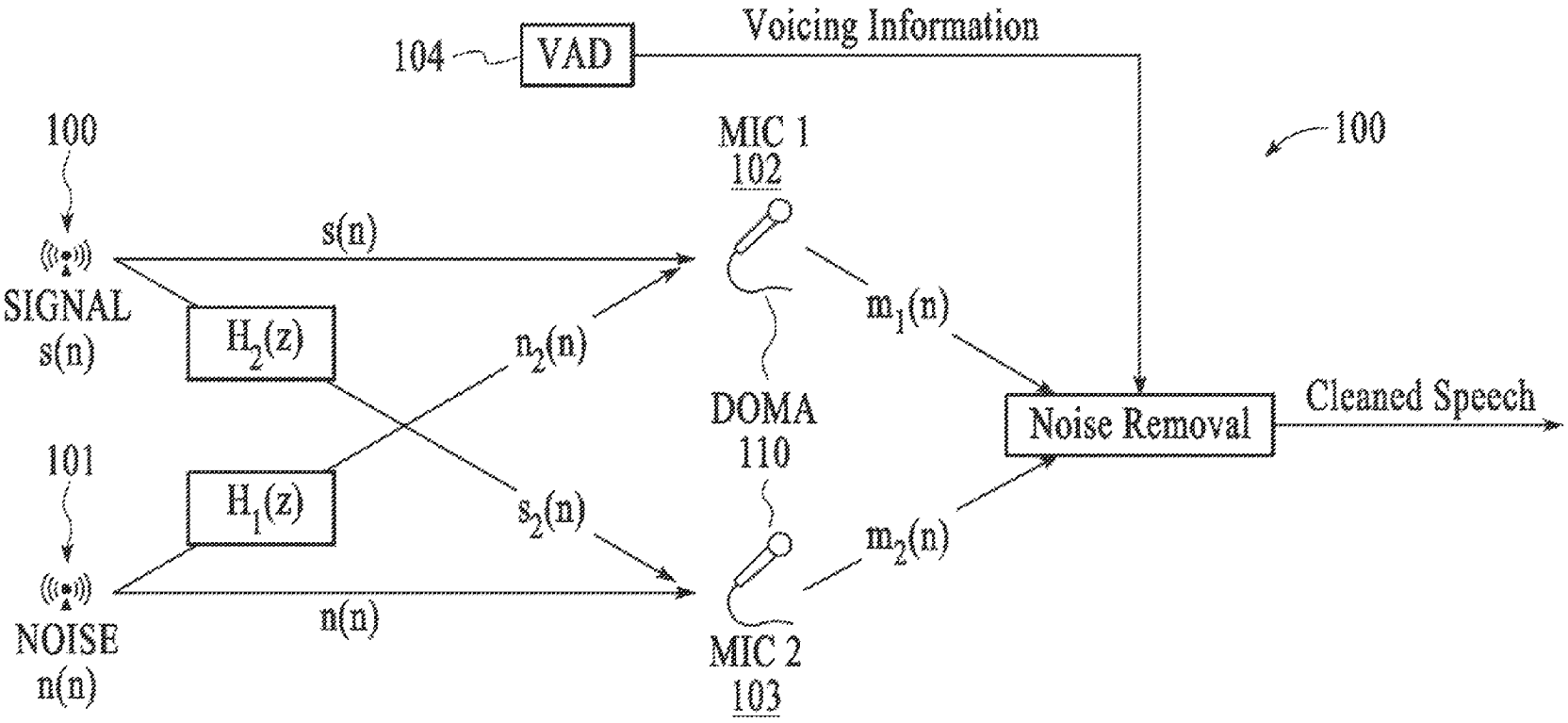
FIG. 1 is a two-microphone adaptive noise suppression system, under an embodiment.

The present invention provides for dual omnidirectional microphone array devices systems and methods.

In accordance with on embodiment, a microphone array is formed with a first virtual microphone that includes a first combination of a first microphone signal and a second microphone signal, wherein the first microphone signal is generated by a first physical microphone and the second microphone signal is generated by a second physical microphone; and a second virtual microphone that includes a second combination of the first microphone signal and the second microphone signal, wherein the second combination is different from the first combination. The first virtual microphone and the second virtual microphone are distinct virtual directional microphones with substantially similar responses to noise and substantially dissimilar responses to speech.

In accordance with another embodiment, a microphone array is formed with a first virtual microphone formed from a first combination of a first microphone signal and a second microphone signal, wherein the first microphone signal is generated by a first omnidirectional microphone and the second microphone signal is generated by a second omnidirectional microphone; and a second virtual microphone formed from a second combination of the first microphone signal and the second microphone signal, wherein the second combination is different from the first combination. The first virtual microphone has a first linear response to speech that has a single null oriented in a direction toward a source of the speech, wherein the speech is human speech.

In accordance with another embodiment, a device includes a first microphone outputting a first microphone signal and a second microphone outputting a second microphone signal; and a processing component coupled to the first microphone signal and the second microphone signal, the processing component generating a virtual microphone array comprising a first virtual microphone and a second virtual microphone, wherein the first virtual microphone comprises a first combination of the first microphone signal and the second microphone signal, and wherein the second virtual microphone comprises a second combination of the first microphone signal and the second microphone signal. The second virtual microphone have substantially similar responses to noise and substantially dissimilar responses to speech.

In accordance with another embodiment, a devise includes a first microphone outputting a first microphone signal and a second microphone outputting a second microphone signal, wherein the first microphone and the second microphone are omnidirectional microphones; and a virtual microphone array comprising a first virtual microphone and a second virtual microphone, wherein the first virtual microphone comprises a first combination of the first microphone signal and the second microphone signal, and the second virtual microphone comprises a second combination of the first microphone signal and the second microphone signal. The second combination is different from the first combination, and the first virtual microphone and the second virtual microphone are distinct virtual directional microphones.

In accordance with another embodiment, a device includes a first physical microphone generating a first microphone signal; a second physical microphone generating a second microphone signal; and a processing component coupled to the first microphone signal and the second microphone signal, the processing component generating a virtual microphone array comprising a first virtual microphone and a second virtual microphone. The first virtual microphone comprises the second microphone signal subtracted from a delayed version of the first microphone signal, and the second virtual microphone comprises a delayed version of the first microphone signal subtracted from the second microphone signal.

In accordance with another embodiment, a sensor includes a physical microphone array including a first physical microphone and a second physical microphone, the first physical microphone outputting a first microphone signal and the second physical microphone outputting a second microphone signal; and a virtual microphone array comprising a first virtual microphone and a second virtual microphone, the first curtail microphone comprising a first combination of the first microphone signal and the second microphone signal, the second virtual microphone comprising a second combination of the first microphone signal and the second microphone signal. The second combination is different from the first combination, and the virtual microphone array includes a single null oriented in a direction toward a source of speech of a human speaker.

DETAILED DESCRIPTION

A dual omnidirectional microphone array (DOMA) that provides improved noise suppression is described herein. Compared to conventional arrays and algorithms, which seek to reduce noise by nulling out noise sources, the array of an embodiment is used to form two distinct virtual directional microphones which are configured to have very similar noise responses and very dissimilar speech responses. The only null formed by the DOMA is one used to remove the speech of the user from $V_2$. The two virtual microphones of an embodiment can be paired with an adaptive filter algorithm and/or VAD algorithm to significantly reduce the noise without distorting the speech, significantly improving the SNR of the desired speech over conventional noise suppression systems. The embodiments described herein are stable in operation, flexible with respect to virtual microphone pattern choice, and have proven to be robust with respect to speech source-to-array distance and orientation as well as temperature and calibration techniques. In the following description, numerous specific details are introduced to provide a thorough understanding of, and enabling description for, embodiments of the DOMA. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

Unless otherwise specified, the following terms have the corresponding meanings in addition to any meaning or understanding they may convey to one skilled in the art.

The term "bleedthrough" means the undesired presence of noise during speech.

The term "denoising" means removing unwanted noise from Mic1, and also refers to the amount of reduction of noise energy in a signal in decibels (dB).

The term "devoicing" means removing/distorting the desired speech from Mic1.

The term "directional microphone (DM)" means a physical directional microphone that is vented on both sides of the sensing diaphragm.

The term "Mic1 (M1)" means a general designation for an adaptive noise suppression system microphone that usually contains more speech than noise.

The term "Mic2 (M2)" means a general designation for an adaptive noise suppression system microphone that usually contains more noise than speech.

The term "noise" means unwanted environmental acoustic noise.

The term "null" means a zero or minima in the spatial response of a physical or virtual directional microphone.

The term "$O_1$" means a first physical omnidirectional microphone used to form a microphone array.

The term "$O_2$" means a second physical omnidirectional microphone used to form a microphone array.

The term "speech" means desired speech of the user.

The term "Skin Surface Microphone (SSM)" is a microphone used in an earpiece (e.g., the Jawbone earpiece available from Aliph of San Francisco, Calif.) to detect speech vibrations on the user's skin.

The term "$V_1$" means the virtual directional "speech" microphone, which has no nulls.

The term "$V_2$" means the virtual directional" noise" microphone, which has a null for the user's speech.

The term "Voice Activity Detection (VAD) signal" means a signal indicating when user speech is detected.

The term "virtual microphones (VM)" or "virtual directional microphones" means a microphone constructed using two or more omnidirectional microphones and associated signal processing.

FIG. 1 is a two-microphone adaptive noise suppression system 100, under an embodiment. The two-microphone system 100 including the combination of physical microphones MIC 1 and MIC 2 along with the processing or circuitry components to which the microphones couple (described in detail below, but not shown in this figure) is referred to herein as the dual omnidirectional microphone array (DOMA) 110, but the embodiment is not so limited. Referring to FIG. 1, in analyzing the single noise source 101 and the direct path to the microphones, the total acoustic information coming into MIC 1 (102, which can be an physical or 5 virtual microphone) is denoted by $m_1(n)$. The total acoustic information coming into MIC 2 (103, which can also be an physical or virtual microphone) is similarly labeled $m_2(n)$. In the z (digital frequency) domain, these are represented as $M_1(z)$ and $M_2(Z)$. Then, $$M_1(z)=S(z)+N_2(z)$$

$$M_2(z)=N(z)+S_2(z),$$

with $$N_2(z)=N(z)H_1(z)$$

$$S_2(z)=S(z)H_2(z),$$

so that $$M_1(z)=S(z)+N(z)H_1(z)$$

$$M_2(z)=N(z)+S(z)H_2(z). \quad \text{Eq. 1}$$

This is the general case for all two microphone systems. Equation 1 has four unknowns and only two known relationships and therefore cannot be solved explicitly.

However, there is another way to solve for some of the unknowns in Equation 1. The analysis starts with an examination of the case where the speech is not being generated, that is, where a signal from the VAD subsystem 104 (optional) equals zero. In this case, s(n)=S(z)=0, and Equation 1 reduces to $$M_{1N}(z)=N(z)H_1(z)$$

$$M_{2N}(z)=N(z),$$

where the N subscript on the M variables indicate that only noise is being received.

This leads to $$M_{1N}(z) = M_{2N}(z)H_1(z) \quad \text{Eq. 2}$$

$$H_1(z) = \frac{M_{1N}(z)}{M_{2N}(z)}.$$

The function $H_1(z)$ can be calculated using any of the available system identification algorithms and the microphone outputs when the system is certain that only noise is being received. The calculation can be done adaptively, so that the system can react to changes in the noise.

A solution is now available for $H_1(z)$, one of the unknowns in Equation 1. The final unknown, $H_2(z)$, can be determined by using the instances where speech is being produced and the VAD equals one. When this is occurring, but the recent (perhaps less than 1 second) history of the microphones indicate low levels of 10 noise, it can be assumed that n(s)=N(z)~O. Then Equation 1 reduces to $$M_{1s}(z)=S(z)$$

$$M_{2s}(z)=S(z)H_2(z),$$

which in turn leads to $$M_{2s}(z) = M_{1s}(z)H_2(z)$$

$$H_2(z) = \frac{M_{2S}(z)}{M_{1S}(z)},$$

which is the inverse of the $H_1(z)$ calculation. However, it is noted that different inputs are being used (now only the speech is occurring whereas before only the noise was occurring). While calculating $H_2(z)$, the values calculated for $H_1(z)$ are held constant (and vice versa) and it is assumed that the noise level is not high enough to cause errors in the $H_2(z)$ calculation.

After calculating $H_1(z)$ and $H_2(z)$, they are used to remove the noise from the signal. If Equation 1 is rewritten as $$S(z)=M_1(z)-N(z)H_1(z)$$

$$N(z)=M_2(z)-S(z)H_2(z)$$

$$S(z)=M_1(z)-[M_2(z)-S(z)H_2(z)]H_1(Z)$$

$$S(z)[1-H_2(z)H_1(z)]=M_1(z)-M_2(z)H_1(z),$$

then N(z) may be substituted as shown to solve for S(z) as $$S(z) = \frac{M_1(z) - M_2(z)H_1(z)}{1 - H_1(z)H_2(z)}. \quad \text{Eq. 3}$$

If the transfer functions $H_1(z)$ and $H_2(z)$ can be described with sufficient accuracy, then the noise can be completely removed and the original signal recovered. This remains true without respect to the amplitude or spectral characteristics of the noise. If there is very little or no leakage from the speech source into $M_2$, then $H_2(z)$~0 and Equation 3 reduces to $$S(z)\approx M_1(z)-M_2(z)H_1(z). \quad \text{Eq. 4}$$

Equation 4 is much simpler to implement and is very stable, assuming $H_1(z)$ is stable. However, if significant speech energy is in $M_2(Z)$, devoicing can occur. In order to construct a well-performing system and use Equation 4, consideration is given to the following conditions:

R1. Availability of a perfect (or at least very good) VAD in noisy conditions

R2. Sufficiently accurate $H_1(z)$

R3. Very small (ideally zero) $H_2(Z)$.

R4. During speech production, $H_1(z)$ cannot change substantially.

R5. During noise, $H_2(z)$ cannot change substantially.

Condition R1 is easy to satisfy if the SNR of the desired speech to the unwanted noise is high enough. "Enough" means different things depending on the method of VAD generation. If a VAD vibration sensor is used, as in Burnett U.S. Pat. No. 7,256,048, accurate VAD in very low SNRs (−10 dB or less) is possible. Acoustic-only methods using information from $O_1$ and $O_2$ can also return accurate VADs, but are limited to SNRs of ~3 dB or greater for adequate performance.

Condition R5 is normally simple to satisfy because for most applications the microphones will not change position with respect to the user's mouth very often or rapidly. In those applications where it may happen (such as hands-free conferencing systems) it can be satisfied by configuring Mic2 so that $H_2(z)\approx 0$.

Satisfying conditions R2, R3, and R4 are more difficult but are possible given the right combination of $V_1$ and $V_2$. Methods are examined below that have proven to be effective in satisfying the above, resulting in excellent noise suppression performance and minimal speech removal and distortion in an embodiment.

The DOMA, in various embodiments, can be used with the Pathfinder system as the adaptive filter system or noise removal. The Pathfinder system, available from AliphCom, San Francisco, Calif., is described in detail in other patents and patent applications referenced herein. Alternatively, any adaptive filter or noise removal algorithm can be used with the DOMA in one or more various alternative embodiments or configurations.

When the DOMA is used with the Pathfinder system, the Pathfinder system generally provides adaptive noise cancellation by combining the two microphone signals (e.g., Mic1, Mic2) by filtering and summing in the time domain. The adaptive filter generally uses the signal received from a first microphone of the DOMA to remove noise from the speech received from at least one other microphone of the DOMA, which relies on a slowly varying linear transfer function between the two microphones for sources of noise. Following processing of the two channels of the DOMA, an output signal is generated in which the noise content is attenuated with respect to the speech content, as described in detail below.

Figure 2:
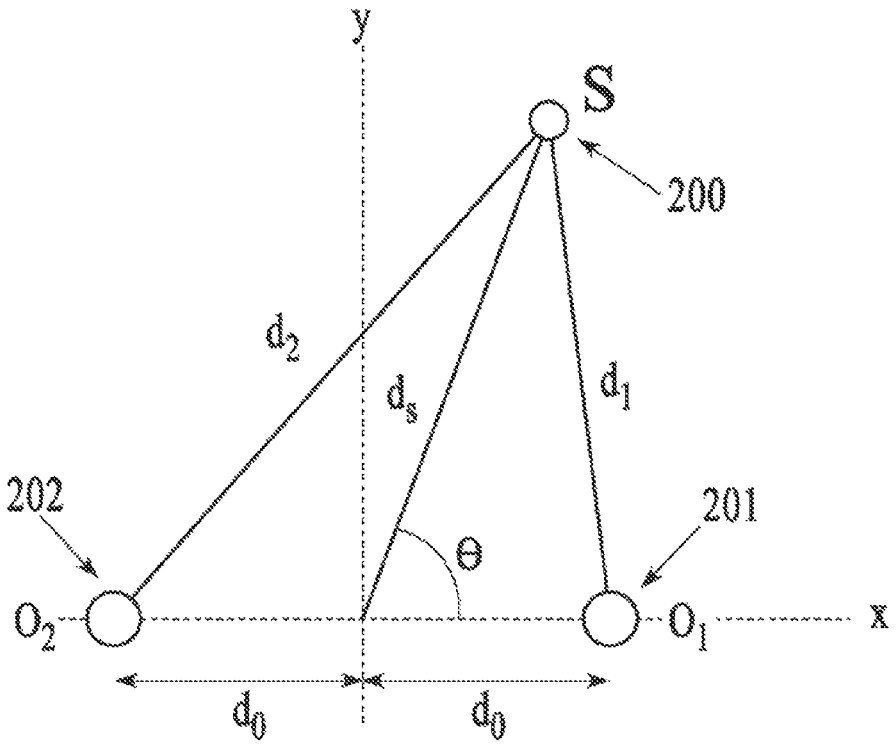
FIG. 2 is an array and speech source (S) configuration, under an embodiment. The microphones are separated by a distance approximately equal to $2d_o$, and the speech source is located a distance $d_s$ away from the midpoint of the array at an angle $\theta$. The system is axially symmetric so only $d_s$ and $\theta$ need be specified.
Figure 3:
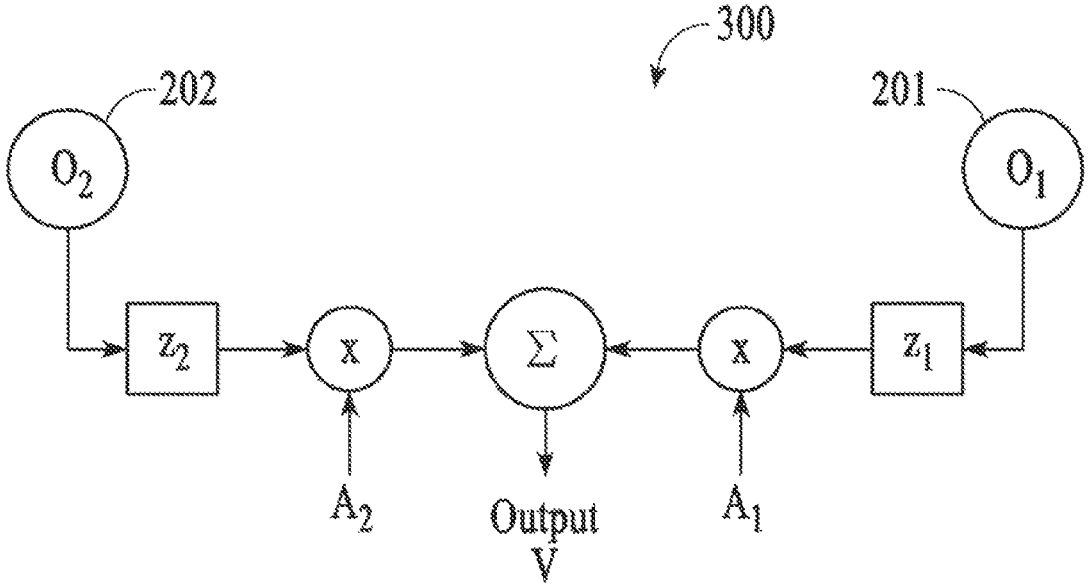
FIG. 3 is a block diagram for a first order gradient microphone using two omnidirectional elements $O_1$ and $O_2$, under an embodiment.

FIG. 2 is a generalized two-microphone array (DOMA) including an array 201/202 and speech source S configuration, under an embodiment. FIG. 3 is a system 300 for generating or producing a first order gradient microphone V using two omnidirectional elements $O_1$ and $O_2$, under an embodiment. The array of an embodiment includes two physical microphones 201 and 202 (e.g., omnidirectional microphones) placed a distance $2d_0$ apart and a speech source 200 is located a distance $d_s$ away at an angle of θ. This array is axially symmetric (at least in free space), so no other angle is needed. The output from each microphone 201 and 202 can be delayed ($Z_1$ and $Z_2$), multiplied by a gain ($A_1$ and $A_2$), and then summed with the other as demonstrated in FIG. 3. The output of the array is or forms at least one virtual microphone, as described in detail below. This operation can be over any frequency range desired. By varying the magnitude and sign of the delays and gains, a wide variety of virtual microphones (VMs), also referred to herein as virtual directional microphones, can be realized. There are other methods known to those skilled in the art for constructing VMs but this is a common one and will be used in the enablement below.

Figure 4:
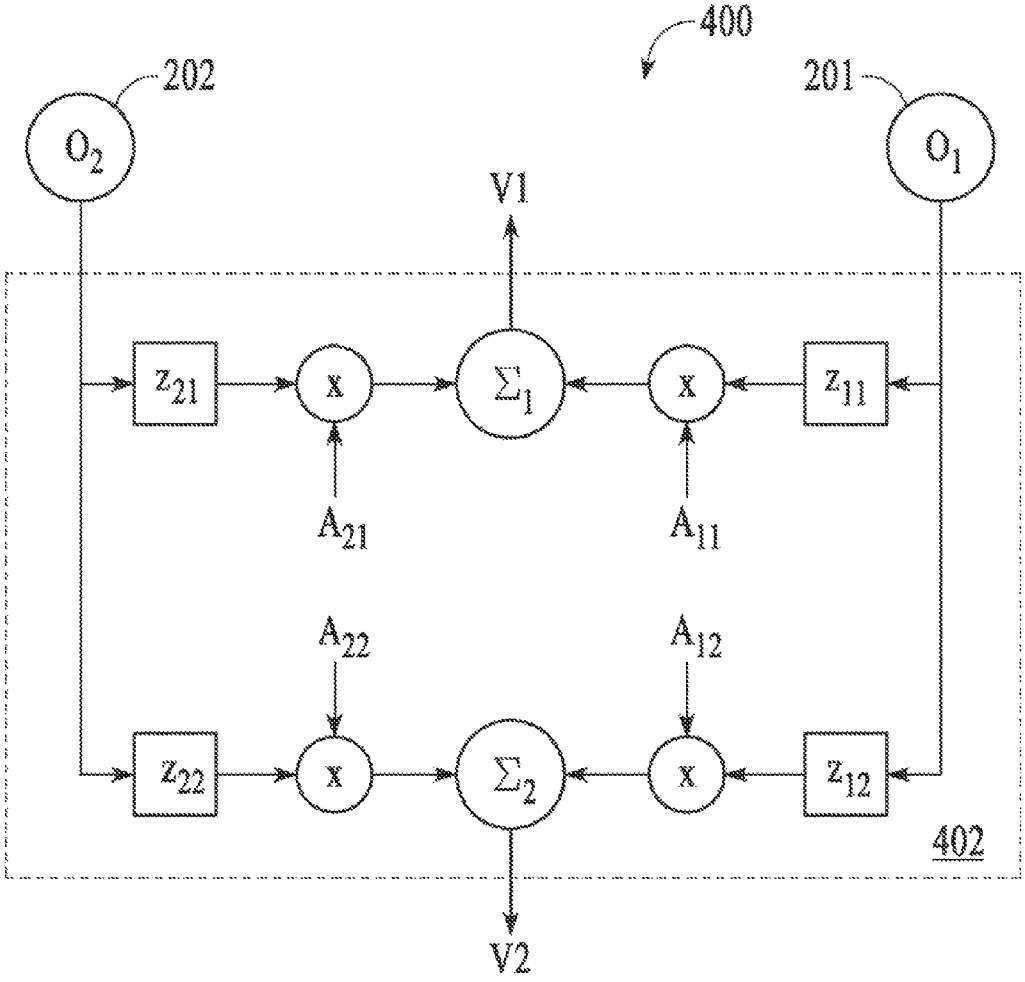
FIG. 4 is a block diagram for a DOMA including two physical microphones configured to form two virtual microphones $V_1$ and $V_2$, under an embodiment.

As an example, FIG. 4 is a block diagram for a DOMA 400 including two physical microphones configured to form two virtual microphones $V_1$ and $V_2$, under an embodiment. The DOMA includes two first order gradient microphones $V_1$ and $V_2$ formed using the outputs of two microphones or elements $O_1$ and $O_2$ (201 and 202), under an embodiment.

The DOMA of an embodiment includes two physical microphones 201 and 202 that are omnidirectional microphones, as described above with reference to FIGS. 2 and 3. The output from each microphone is coupled to a processing component 402, or circuitry, and the processing component outputs signals representing or corresponding to the virtual microphones $V_1$ and $V_2$.

In this example system 400, the output of physical microphone 201 is coupled to processing component 402 that includes a first processing path that includes application of a first delay $Z_{11}$ and a first gain $A_{11}$ and a second processing path that includes application of a second delay $Z_{12}$ and a second gain $A_{12}$. The output of physical microphone 202 is coupled to a third processing path of the processing component 402 that includes application of a third delay $Z_{21}$ and a third gain $A_{21}$ and a fourth processing path that includes application of a fourth delay $Z_{22}$ and a fourth gain $A_{22}$. The output of the first and third processing paths is summed to form virtual microphone $V_1$, and the output of the second and fourth processing paths is summed to form virtual microphone $V_2$.

Figure 5:
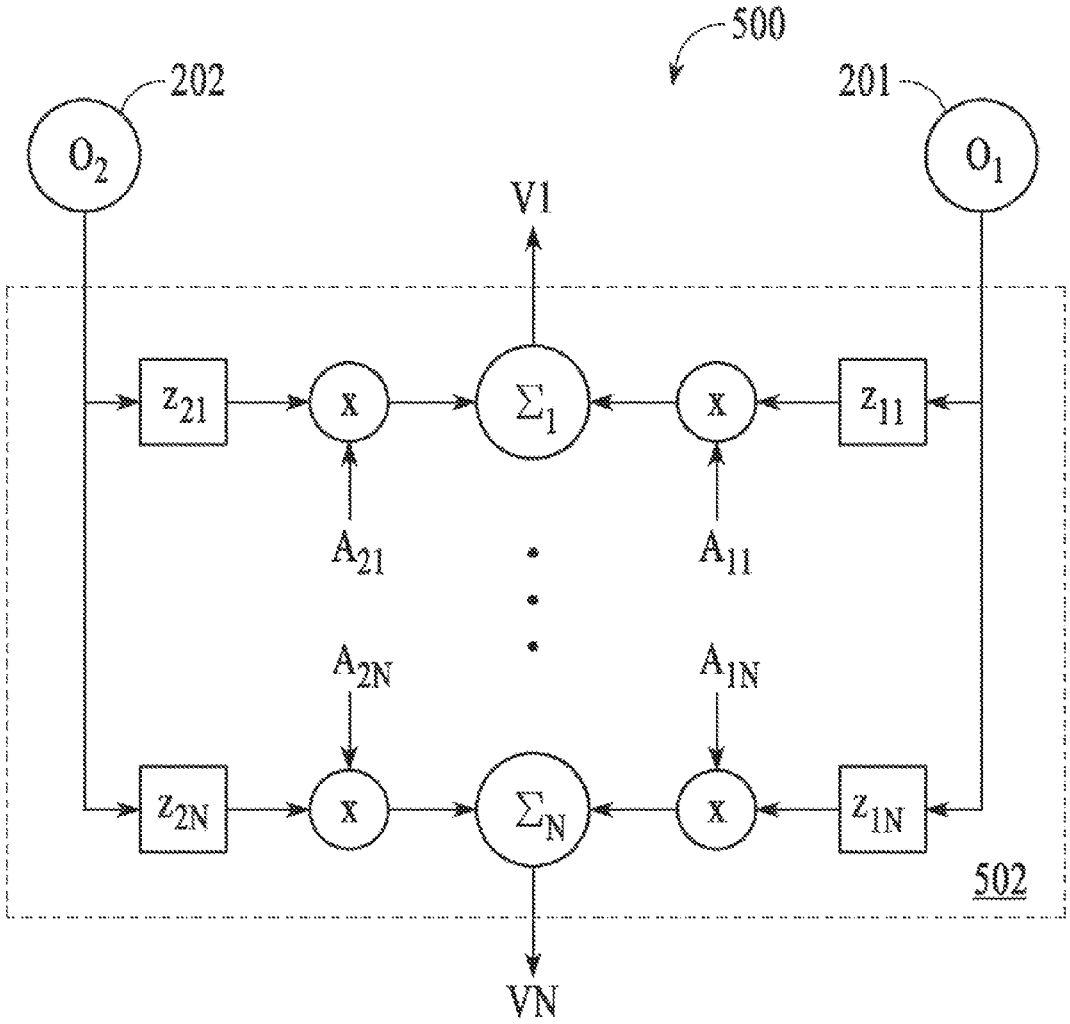
FIG. 5 is a block diagram for a DOMA including two physical microphones configured to form N virtual microphones $V_1$ through $V_N$, where N is any number greater than one, under an embodiment.

As described in detail below, varying the magnitude and sign of the delays and gains of the processing paths leads to a wide variety of virtual microphones (VMs), also referred to herein as virtual directional microphones, can be realized. While the processing component 402 described in this example includes four processing paths generating two virtual microphones or microphone signals, the embodiment is not so limited. For example, FIG. 5 is a block diagram for a DOMA 500 including two physical microphones configured to form N virtual microphones $V_1$ through $V_N$, where N is any number greater than one, under an embodiment. Thus, the DOMA can include a processing component 502 having any number of processing paths as appropriate to form a number N of virtual microphones.

The DOMA of an embodiment can be coupled or connected to one or more remote devices. In a system configuration, the DOMA outputs signals to the 5 remote devices. The remote devices include, but are not limited to, at least one of cellular telephones, satellite telephones, portable telephones, wireline telephones, Internet telephones, wireless transceivers, wireless communication radios, personal digital assistants (PDAs), personal computers (PCs), headset devices, head-worn devices, and earpieces.

Furthermore, the DOMA of an embodiment can be a component or subsystem integrated with a host device. In this system configuration, the DOMA outputs signals to components or subsystems of the host device. The host device includes, but is not limited to, at least one of cellular telephones, satellite telephones, portable telephones, wireline telephones, Internet telephones, wireless transceivers, wireless communication radios, personal digital assistants (PDAs), personal computers (PCs), headset devices, head-worn devices, and earpieces.

Figure 6:
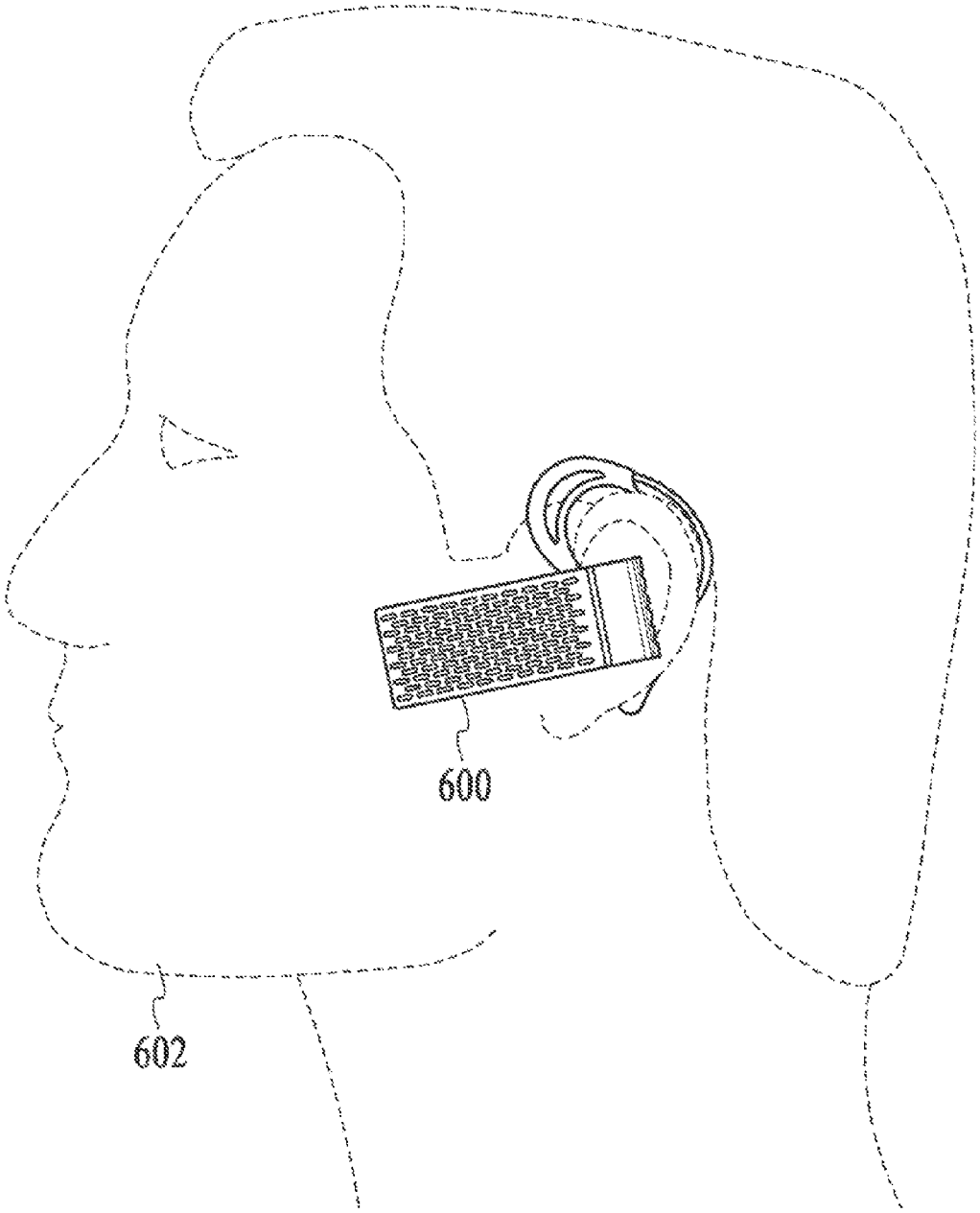
FIG. 6 is an example of a headset or head-worn device that includes the DOMA, as described herein, under an embodiment.

As an example, FIG. 6 is an example of a headset or head-worn device 600 that includes the DOMA, as described herein, under an embodiment. The headset 600 of an embodiment includes a housing having two areas or receptacles (not shown) that receive and hold two microphones (e.g., $O_1$ and $O_2$), The headset 600 is generally a device that can be worn by a speaker 602, for example, a headset or earpiece that positions or holds the microphones in the vicinity of the speaker's mouth. The headset 600 of an embodiment places a first physical microphone (e.g., physical microphone $O_1$) in a vicinity of a speaker's lips. A second physical microphone (e.g., physical microphone $O_2$) is placed a distance behind the first physical microphone. The distance of an embodiment is in a range of a few centimeters behind the first physical microphone or as described herein (e.g., described with reference to FIGS. 1-5). The DOMA is symmetric and is used in the same configuration or manner as a single close-talk microphone, but is not so limited.

Figure 7:
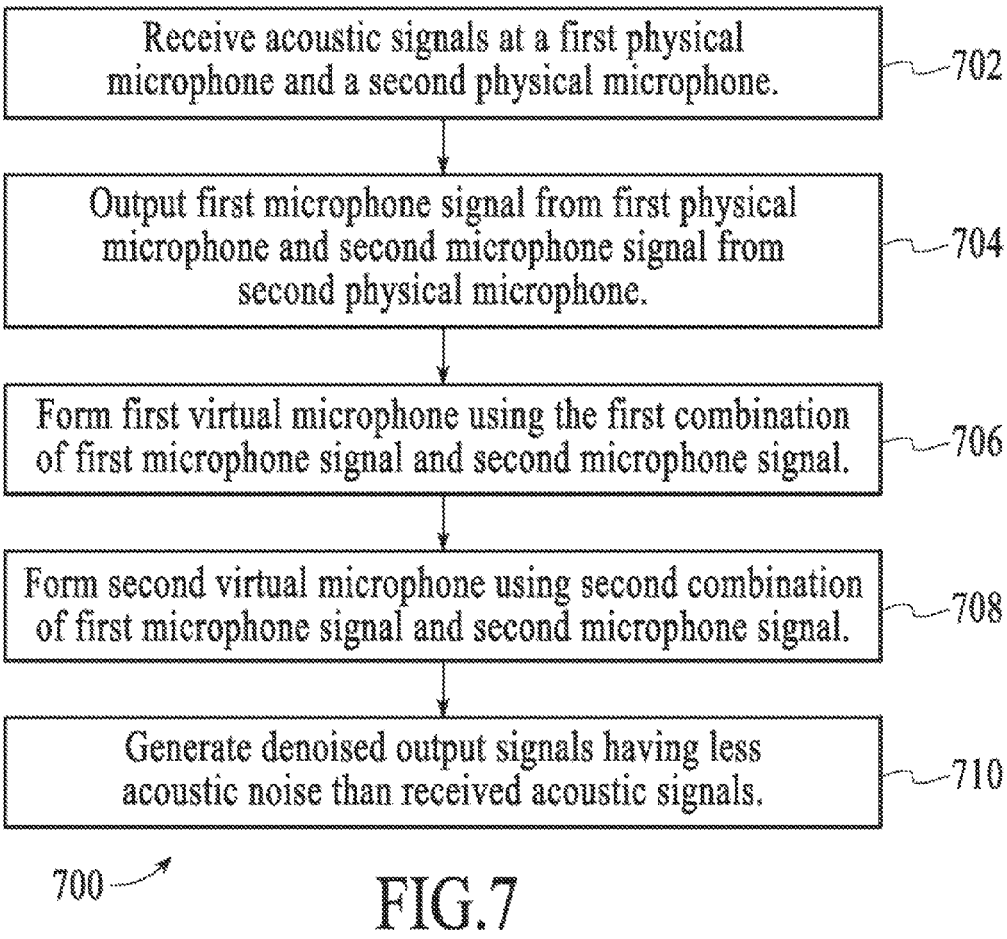
FIG. 7 is a flow diagram for denoising acoustic signals using the DOMA, under an embodiment.

FIG. 7 is a flow diagram for denoising 700 acoustic signals using the DOMA, under an embodiment. The denoising 700 begins by receiving 702 acoustic signals at a first physical microphone and a second physical microphone. In response to the acoustic signals, a first microphone signal is output from the first physical microphone and a second microphone signal is output from the second physical microphone 704. A first virtual microphone is formed 706 by generating a first combination of the first microphone signal and the second microphone signal. A second virtual microphone is formed 708 by generating a second combination of the first microphone signal and the second microphone signal, and the second combination is different from the first combination. The first virtual microphone and the second virtual microphone are distinct virtual directional microphones with substantially similar responses to noise and substantially dissimilar responses to speech. The denoising 700 generates 710 output signals by combining signals from the first virtual microphone and the second virtual microphone, and the output signals include less acoustic noise than the acoustic signals.

Figure 8:
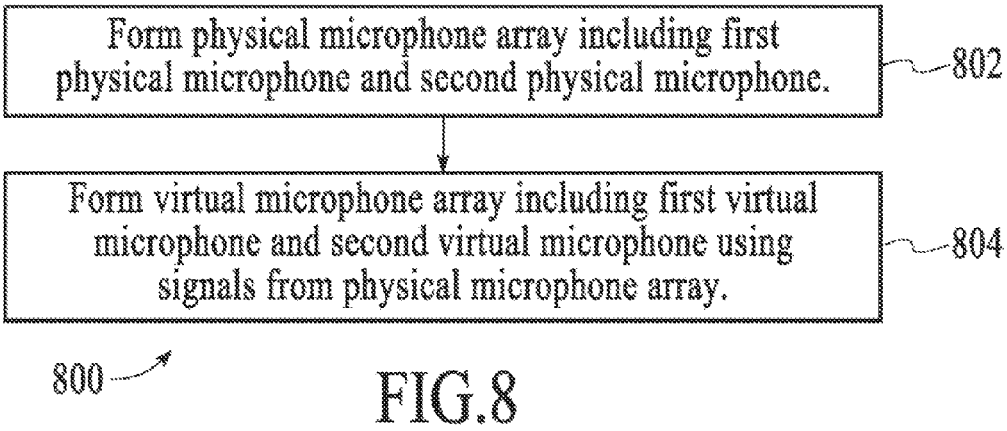
FIG. 8 is a flow diagram for forming the DOMA, under an embodiment.

FIG. 8 is a flow diagram for forming 800 the DOMA, under an embodiment. Formation 800 of the DOMA includes forming 802 a physical microphone array including a first physical microphone and a second physical microphone. The first physical microphone outputs a first microphone signal and the second physical microphone outputs a second microphone signal. A virtual microphone array is formed 804 comprising a first virtual microphone and a second virtual microphone. The first virtual microphone comprises a first combination of the first microphone signal and the second microphone signal. The second virtual microphone comprises a second combination of the first microphone signal and the second microphone signal, and the second combination is different from the first combination. The virtual microphone array including a single null oriented in a direction toward a source of speech of a human speaker.

The construction of VMs for the adaptive noise suppression system of an embodiment includes substantially similar noise response in $V_1$ and $V_2$. Substantially similar noise response as used herein means that $H_1(z)$ is simple to model and will not change much during speech, satisfying conditions R2 and R4 described above and allowing strong denoising and minimized bleedthrough.

The construction of VMs for the adaptive noise suppression system of an embodiment includes relatively small speech response for $V_2$. The relatively small speech response for $V_2$ means that $H_2(z) \approx 0$, which will satisfy conditions R3 and R5 described above.

The construction of VMs for the adaptive noise suppression system of an embodiment further includes sufficient speech response for $V_1$ so that the cleaned speech will have significantly higher SNR than the original speech captured by $O_1$.

The description that follows assumes that the responses of the omnidirectional microphones $O_1$ and $O_2$ to an identical acoustic source have been normalized so that they have exactly the same response (amplitude and phase) to that source. This can be accomplished using standard microphone array methods (such as frequency-based calibration) well known to those versed in the art.

Referring to the condition that construction of VMs for the adaptive noise suppression system of an embodiment includes relatively small speech response for $V_2$, it is seen that for discrete systems $V_2(z)$ can be represented as:

$$V_2(z) = O_2(z) - z^{-\gamma}\beta O_1(z)$$

where $$\beta = \frac{d_1}{d_2}$$

$$\gamma_{-} = \frac{d_2 - d_1}{c} \cdot f_x \text{ (samples)}$$

$$d_1 = \sqrt{d_S^2 - 2d_{S1}d_0\cos(\theta) + d_0^2}$$

$$d_2 = \sqrt{d_S^2 + 2d_S d_0\cos(\theta) + d_0^2}$$

The distances $d_1$ and $d_2$ are the distance from $O_1$ and $O_2$ to the speech source (see FIG. 2), respectively, and $\gamma$ is their difference divided by c, the speed of sound, and multiplied by the sampling frequency $f_s$. Thus $\gamma$ is in samples, but need not be an integer. For non-integer $\gamma$, fractional-delay filters (well known to those versed in the art) may be used.

It is important to note that the $\beta$ above is not the conventional $\beta$ used to denote the mixing of VMs in adaptive beamforming; it is a physical variable of the system that depends on the intra-microphone distance do (which is fixed) and the distance $d_s$ and angle $\theta$, which can vary. As shown below, for properly calibrated microphones, it is not necessary for the system to be programmed with the exact $\beta$ of the array. Errors of approximately 10-15% in the actual t (i.e. the $\beta$ used by the algorithm is not the $\beta$ of the physical array) have been used with very little degradation in quality. The algorithmic value of $\beta$ may be calculated and set for a particular user or may be calculated adaptively during speech production when little or no noise is present. However, adaptation during use is not required for nominal performance.

Figure 9:
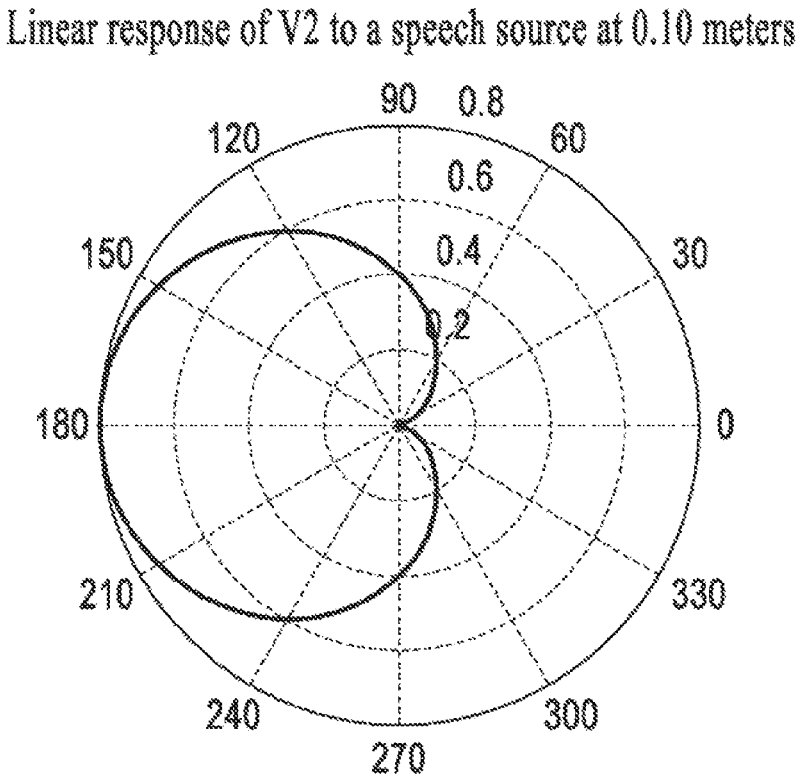
FIG. 9 is a plot of linear response of virtual microphone $V_2$ to a 1 kHz speech source at a distance of 0.1 m, under an embodiment. The null is at 0 degrees, where the speech is normally located.
Figure 10:
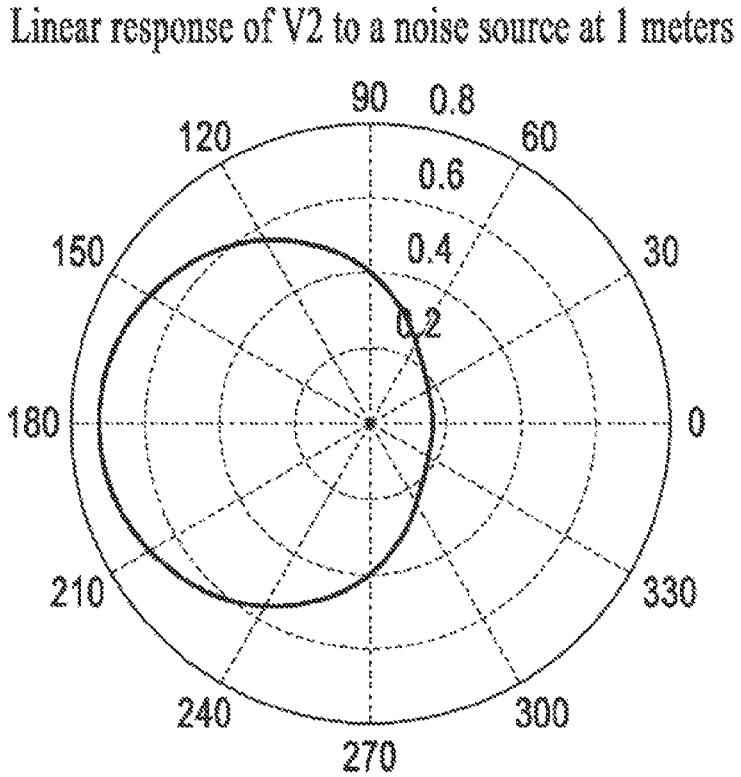
FIG. 10 is a plot of linear response of virtual microphone $V_2$ to a 1 kHz noise source at a distance of 1.0 m, under an embodiment. There is no null and all noise sources are detected.

FIG. 9 is a plot of linear response of virtual microphone $V_2$ with $\beta$=0.8 to a 1 kHz speech source at a distance of 0.1 m, under an embodiment. The null in the linear response of virtual microphone $V_2$ to speech is located at 0 degrees, where the speech is typically expected to be located. FIG. 10 is a plot of linear response of virtual microphone $V_2$ with $\beta$=0.8 to a 1 kHz noise source at a distance of 1.0 m, under an embodiment. The linear response of $V_2$ to noise is devoid of or includes no null, meaning all noise sources are detected.

The above formulation for $V_2(z)$ has a null at the speech location and will therefore exhibit minimal response to the speech. This is shown in FIG. 9 for an array with $d_0$=10.7 mm and a speech source on the axis of the array ($\theta$=0) at 10 cm ($\beta$=0.8). Note that the speech null at zero degrees is not present for noise in the far field for the same microphone, as shown in FIG. 10 with a noise source distance of approximately 1 meter. This insures that noise in front of the user will be detected so that it can be removed. This differs from conventional systems that can have difficulty removing noise in the direction of the mouth of the user.

The $V_1(z)$ can be formulated using the general form for $V_1(z)$:

$$V_1(z)=\alpha_A O_1(z)\cdot z^{-d_A-\alpha_B}O_2(z)\cdot z^{-d_B}$$

Since $$V_2(z)=O_2(z)-z^{-\gamma}\beta O_1(z)$$

and, since for noise in the forward direction $$O_{2N}(z)=O_{1N}(z)z^{-\gamma},$$

Then $$V_{2N}(z)=O_{1N}(z)\cdot z^{-\gamma}-z^{-\gamma}\beta O_{1N}(z)$$

$$V_{2N}(z)=(1-\beta)(O_{1N}(z)\cdot z^{-\gamma})$$

If this is then set equal to $V_1(z)$ above, the result is $$V_{1N}(z)=\alpha_A O_{1N}(z)\cdot z^{-d_A-\alpha_B}O_{1N}(z)\cdot z^{-\gamma}\cdot z^{-d_B}=(1-\beta)(O_{1N}(z)\cdot z^{-\gamma})$$

thus we may set $d_A=\gamma$
$d_B=0$
$\alpha_A=1$
$\alpha_A=\beta$ to get $$V_1(z)=O_1(z)\cdot z^{-\gamma}-\beta O_2(z)$$

The definitions for $V_1$ and $V_2$ above mean that for noise $H_1(z)$ is:

$$H_1(z) = \frac{V_1(z)}{V_2(z)} = \frac{\beta O_2(z) + O_1(z)\cdot z^{-\gamma}}{O_2(z) - z^{-\gamma}\beta O_1(z)}$$

which, if the amplitude noise responses are about the same, has the form of an allpass filter. This has the advantage of being easily and accurately modeled, especially in magnitude response, satisfying R2.

This formulation assures that the noise response will be as similar as possible and that the speech response will be proportional to $(1-\beta^2)$. Since $\beta$ is the ratio of the distances from $O_1$ and $O_2$ to the speech source, it is affected by the size of the array and the distance from the array to the speech source.

Figure 11:
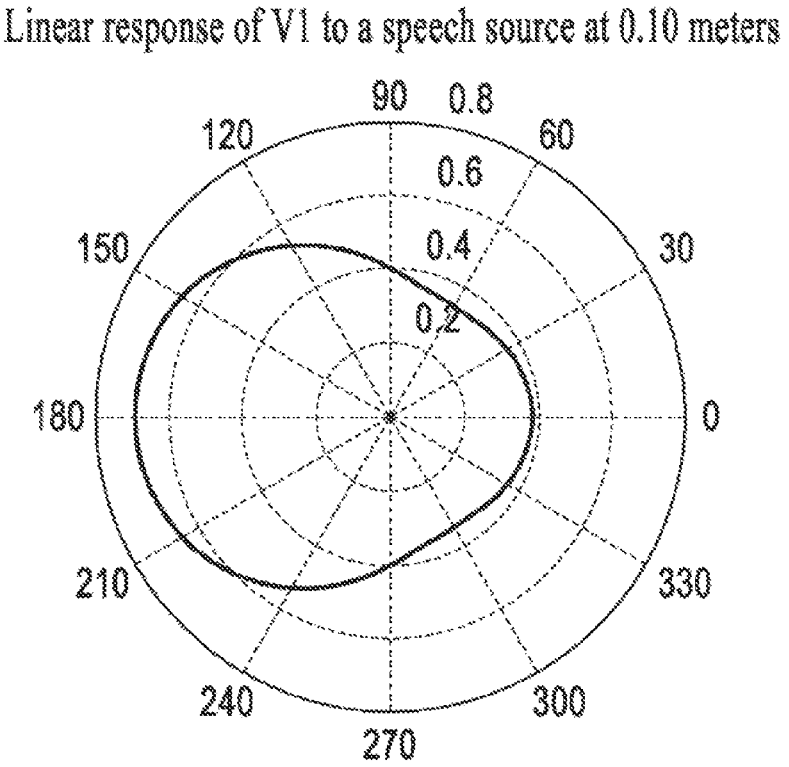
FIG. 11 is a plot of linear response of virtual microphone $V_1$ to a 1 kHz speech source at a distance of 0.1 m, under an embodiment. There is no null and the response for speech is greater than that shown in FIG. 9.

FIG. 11 is a plot of linear response of virtual microphone $V_1$ with $\beta$=0.8 to a 1 kHz speech source at a distance of 0.1 m, under an embodiment. The linear response of virtual microphone $V_1$ to speech is devoid of or includes no null and the response for speech is greater than that shown in FIG. 4.

Figure 12:
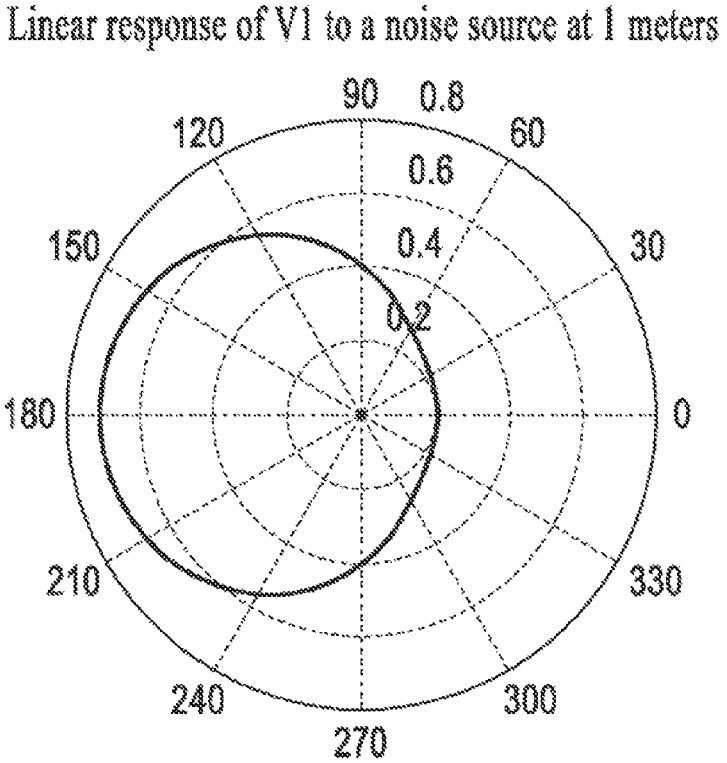
FIG. 12 is a plot of linear response of virtual microphone $V_1$ to a 1 kHz noise source at a distance of 1.0 m, under an embodiment. There is no null and the response is very similar to $V_2$ shown in FIG. 10.

FIG. 12 is a plot of linear response of virtual microphone $V_1$ with $\beta$=0.8 to a 1 kHz noise source at a distance of 1.0 m, under an embodiment. The linear response of virtual microphone $V_1$ to noise is devoid of or includes no null and the response is very similar to $V_2$ shown in FIG. 5.

Figure 13:
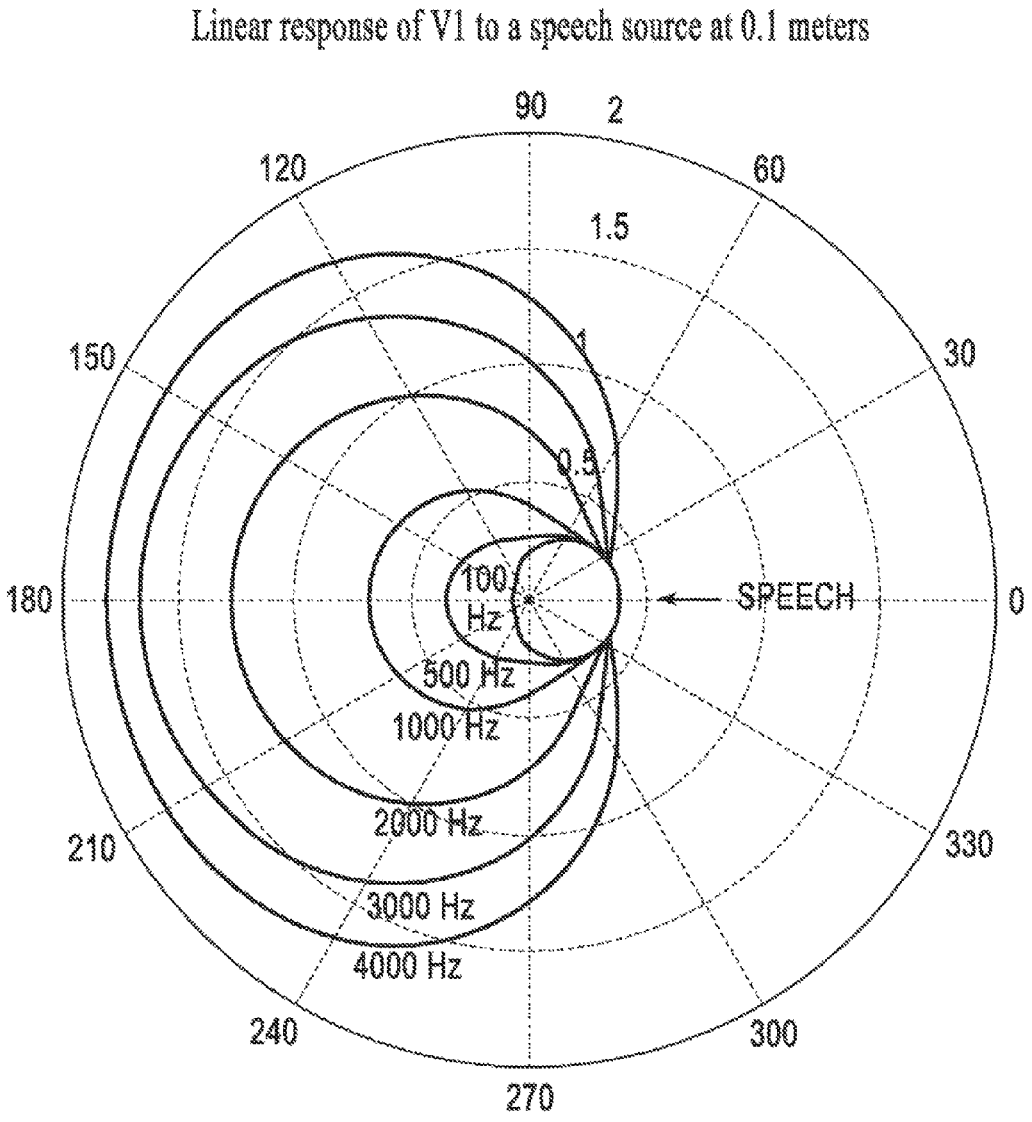
FIG. 13 is a plot of linear response of virtual microphone $V_1$ to a speech source at a distance of 0.1 m for frequencies of 100, 500, 1000, 2000, 3000, and 4000 Hz, under an embodiment.
Figure 14:
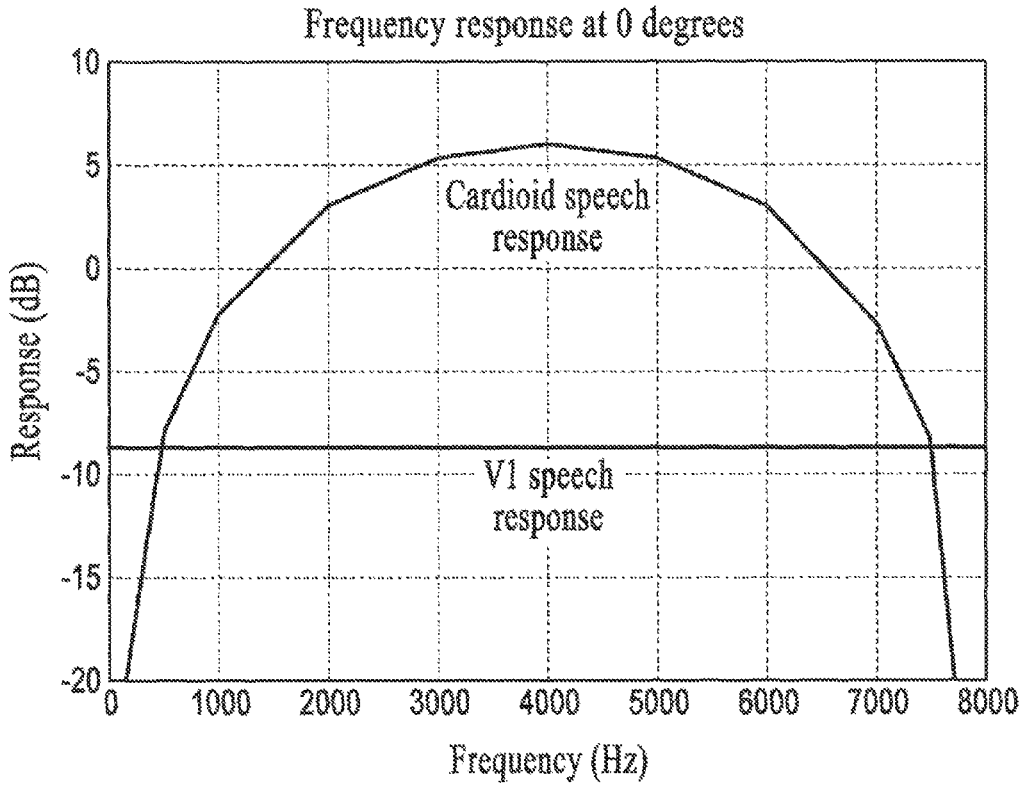
FIG. 14 is a plot showing comparison of frequency responses for speech for the array of an embodiment and for a conventional cardioid microphone.

FIG. 13 is a plot of linear response of virtual microphone $V_1$ with $\beta$=0.8 10 to a speech source at a distance of 0.1 m for frequencies of 100, 500, 1000, 2000, 3000, and 4000 Hz, under an embodiment. FIG. 14 is a plot showing comparison of frequency responses for speech for the array of an embodiment and for a conventional cardioid microphone.

The response of $V_1$ to speech is shown in FIG. 11, and the response to noise in FIG. 12. Note the difference in speech response compared to $V_2$ shown in FIG. 9 and the similarity of noise response shown in FIG. 10. Also note that the orientation of the speech response for $V_1$ shown in FIG. 11 is completely opposite the orientation of conventional systems, where the main lobe of response is normally oriented toward the speech source. The orientation of an embodiment, in which the main lobe of the speech response of $V_1$ is oriented away from the speech source, means that the speech sensitivity of $V_1$ is lower than a normal directional microphone but is flat for all frequencies within approximately +−30 degrees of the axis of the array, as shown in FIG. 13. This flatness of response for speech means that no shaping postfilter is needed to restore omnidirectional frequency response. This does come at a price—as shown in FIG. 14, which shows the speech response of $V_1$ with $\beta$=0.8 and the speech response of a cardioid microphone. The speech response of $V_1$ is approximately 0 to ~13 dB less than a normal directional microphone between approximately 500 and 7500 Hz and approximately 0 to 10+dB greater than a directional microphone below approximately 500 Hz and above 7500 Hz for a sampling frequency of approximately 16000 Hz. However, the superior noise suppression made possible using this system more than compensates for the initially poorer SNR.

It should be noted that FIGS. 9-12 assume the speech is located at approximately 0 degrees and approximately 10 cm, $\beta$=0.8, and the noise at all angles is located approximately 1.0 meter away from the midpoint of the array. Generally, the noise distance is not required to be 1 m or more, but the denoising is the best for those distances. For distances less than approximately 1 m, denoising will not be as effective due to the greater dissimilarity in the noise responses of $V_1$ and $V_2$. This has not proven to be an impediment in practical use—in fact, it can be seen as a feature. Any "noise" source that is −10 cm away from the earpiece is likely to be desired to be captured and transmitted.

The speech null of $V_2$ means that the VAD signal is no longer a critical component. The VAD's purpose was to ensure that the system would not train on speech and then subsequently remove it, resulting in speech distortion. If, however, $V_2$ contains no speech, the adaptive system cannot train on the speech and cannot remove it. As a result, the system can denoise all the time without fear of devoicing, and the resulting clean audio can then be used to generate a VAD signal for use in subsequent single-channel noise suppression algorithms such as spectral subtraction. In addition, constraints on the absolute value of $H_1(z)$ (i.e. restricting it to absolute values less than two) can keep the system from fully training on speech even if it is detected. In reality, though, speech can be present due to a mis-located $V_2$ null and/or echoes or other phenomena, and a VAD sensor or other acoustic-only VAD is recommended to minimize speech distortion.

Depending on the application, $\beta$ and $\gamma$ may be fixed in the noise suppression algorithm or they can be estimated when the algorithm indicates that speech production is taking place in the presence of little or no noise. In either case, there may be an error in the estimate of the actual $\beta$ and $\gamma$ of the system. The following description examines these errors and their effect on the performance of the system. As above, "good performance" of the system indicates that there is sufficient denoising and minimal devoicing.

The effect of an incorrect $\beta$ and $\gamma$ on the response of $V_1$ and $V_2$ can be seen by examining the definitions above:

$$V_1(z)=O_1(z)\cdot z^{-\gamma T-\beta}{}_T O_2(z)$$

$$V_2(z)=O_2(z)\cdot z^{-\gamma T\beta}{}_T O_1(z)$$

where $\beta_T$ and $\gamma_T$ denote the theoretical estimates of $\beta$ and $\gamma$ used in the noise suppression algorithm. In reality, the speech response of $O_2$ is $$O_{2S}(z)=\beta_R O_{1S}(z)\cdot z^{-\gamma R}$$

where $\beta_R$ and $\gamma_R$ denote the real $\beta$ and $\gamma$ of the physical system. The differences between the theoretical and actual values of $\beta$ and $\gamma$ can be due to mis-location of the speech source (it is not where it is assumed to be) and/or a change in air temperature (which changes the speed of sound). Inserting the actual response of $O_2$ for speech into the above equations for $V_1$ and $V_2$ yields $$V_{1S}(z)=O_{1S}(z)[z^{-\gamma T-\beta T}\beta_R z^{-\gamma R}]$$

$$V_{2S}(z)=O_{1S}(z)[\beta_R z^{-\gamma R-\beta T} z^{-\gamma T}]$$

If the difference in phase is represented by $$\gamma_R=\gamma_T+\gamma_D$$

And the difference in amplitude as $$\gamma_R=B\beta_T$$

then $$V_{1S}(z)=O_{1S}(z)z^{-\gamma T}[1-B\beta_T^2 z^{-\gamma D}]$$

$$V_{2S}(z)=\beta_T O_{1S}(z)z^{-\gamma T[Bz-\gamma D}-1]$$

Figure 15:
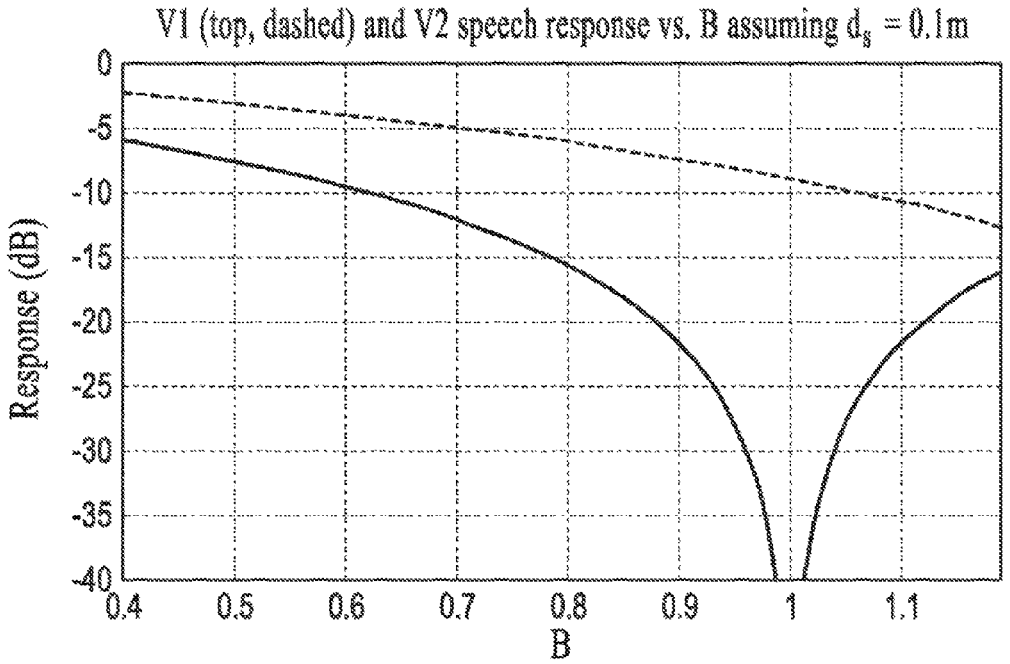
FIG. 15 is a plot showing speech response for $V_1$ (top, dashed) and $V_2$ (bottom, solid) versus B with $d_s$ assumed to be 0.1 m, under an embodiment. The spatial null in $V_2$ is relatively broad.
Figure 16:
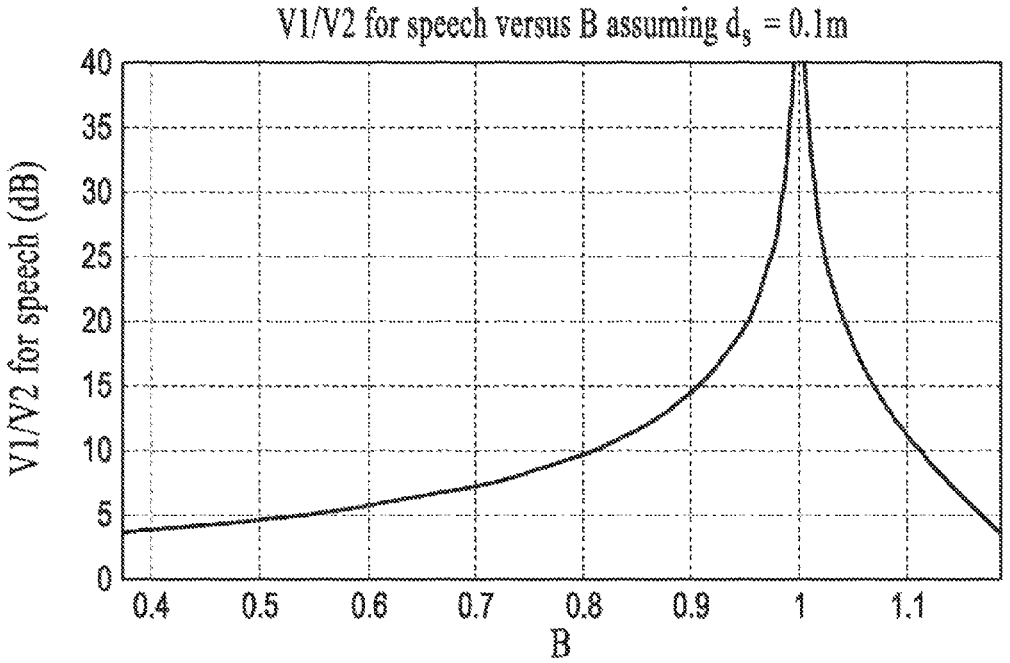
FIG. 16 is a plot showing a ratio of $V_1/V_2$ speech responses shown in FIG. 10 versus B, under an embodiment. The ratio is above 10 dB for all $0.8<B<1.1$. This means that the physical β of the system need not be exactly modeled for good performance.
Figure 17:
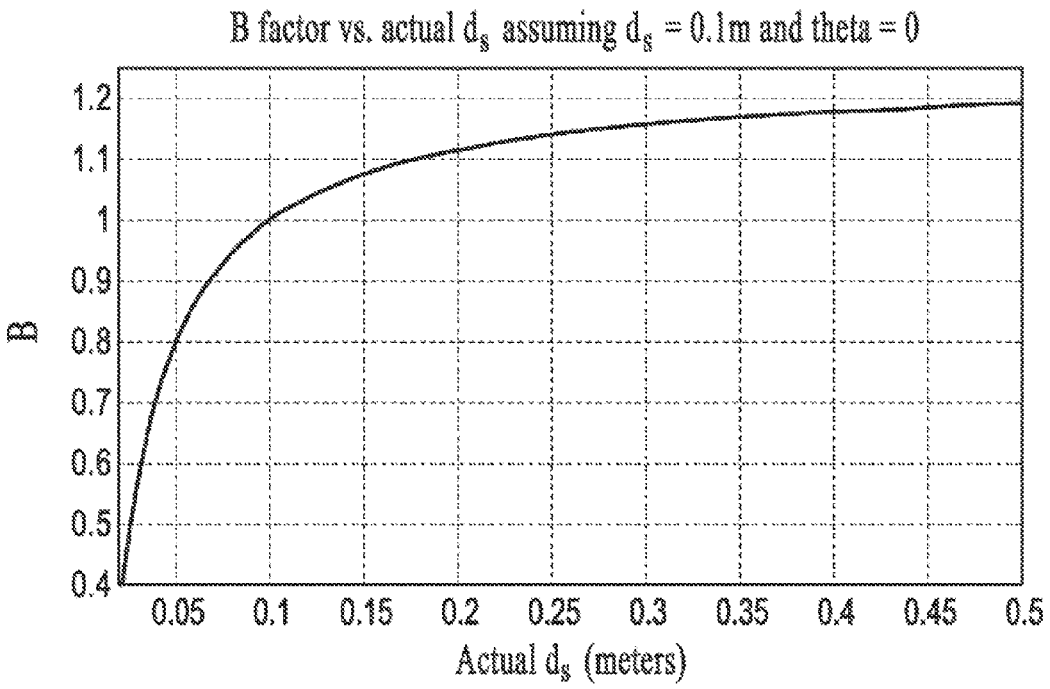
FIG. 17 is a plot of B versus actual $d_s$ assuming that $d_s$=10 cm and theta=0, under an embodiment.
Figure 18:
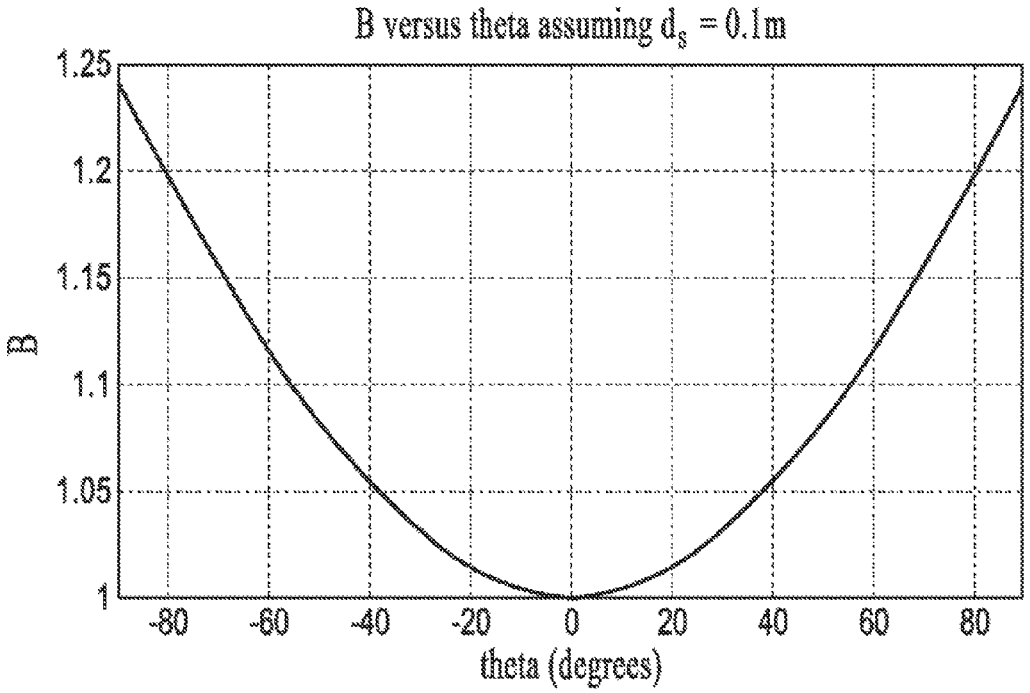
FIG. 18 is a plot of B versus theta with $d_s$=10 cm and assuming $d_s$=10 cm, under an embodiment.

The speech cancellation in $V_2$ (which directly affects the degree of devoicing) and the speech response of $V_1$ will be dependent on both B and D. An examination of the case where D=0 follows. FIG. 15 is a plot showing speech response for $V_1$ (top, dashed) and $V_2$ (bottom, solid) versus B with $d_s$ assumed to be 0.1 m, under an embodiment. This plot shows the spatial null in $V_2$ to be relatively broad. FIG. 16 is a plot showing a ratio of $V_1V_2$ speech responses shown in FIG. 10 versus B, under an embodiment. The ratio of $V_1/V_2$ is above 10 dB for all 0.8<B<1.1, and this means that the physical $\beta$ of the system need not be exactly modeled for good performance. FIG. 17 is a plot of B versus actual $d_s$ assuming that $d_s$=10 cm and theta=0, under an embodiment. FIG. 18 is a plot of B versus theta with $d_s$=10 cm and assuming $d_s$=10 cm, under an embodiment.

In FIG. 15, the speech response for $V_1$ (upper, dashed) and $V_2$ (lower, solid) compared to $O_1$ is shown versus B when ds is thought to be approximately 10 cm and 8=O. When B=1, the speech is absent from $V_2$. In FIG. 16, the ratio of the speech responses in FIG. 10 is shown. When 0.8<B<1.1, the $V_1/V_2$ ratio is above approximately 10 dB—enough for good performance. Clearly, if D=0, B can vary significantly without adversely affecting the performance of the system. Again, this assumes that calibration of the microphones so that both their amplitude and phase response is the same for an identical source has been performed.

The B factor can be non-unity for a variety of reasons. Either the distance to the speech source or the relative orientation of the array axis and the speech source or both can be different than expected. If both distance and angle mismatches are included for B, then $$B=\frac{\beta_R}{\beta_T}\frac{\sqrt{d_{SR}^2-2d_{SR}d_0\cos(\theta_R)+d_0^2}}{\sqrt{d_{SR}^2+2d_{SR}d_0\cos(\theta_R)+d_0^2}}\cdot\frac{\sqrt{d_{ST}^2+2d_{ST}d_0\cos(\theta_T)+d_0^2}}{\sqrt{d_{ST}^2-2d_{ST}d_0\cos(\theta_T)+d_0^2}}$$

where again the T subscripts indicate the theorized values and R the actual values.

In FIG. 17, the factor B is plotted with respect to the actual $d_s$ with the assumption that $d_s$=10 cm and θ=O. So, if the speech source in on-axis of the array, the actual distance can vary from approximately 5 cm to 18 cm without significantly affecting performance—a significant amount. Similarly, FIG. 18 shows what happens if the speech source is located at a distance of approximately 10 cm but not on the axis of the array. In this case, the angle can vary up to approximately +−55 degrees and still result in a B less than 1.1, assuring good performance. This is a significant amount of allowable angular deviation. If there is both angular and distance errors, the equation above may be used to determine if the deviations will result in adequate performance. Of course, if the value for $\beta_T$ is allowed to update during speech, essentially tracking the speech source, then B can be kept near unity for almost all configurations.

An examination follows of the case where B is unity but D is nonzero. This can happen if the speech source is not where it is thought to be or if the speed of sound is different from what it is believed to be. From Equation 5 above, it can be sees that the factor that weakens the speech null in $V_2$ for speech is $$N(z)=Bz^{-YD}-1$$

or in the continuous s domain $$N(s)=Be^{-Ds}-1$$

Figure 19:
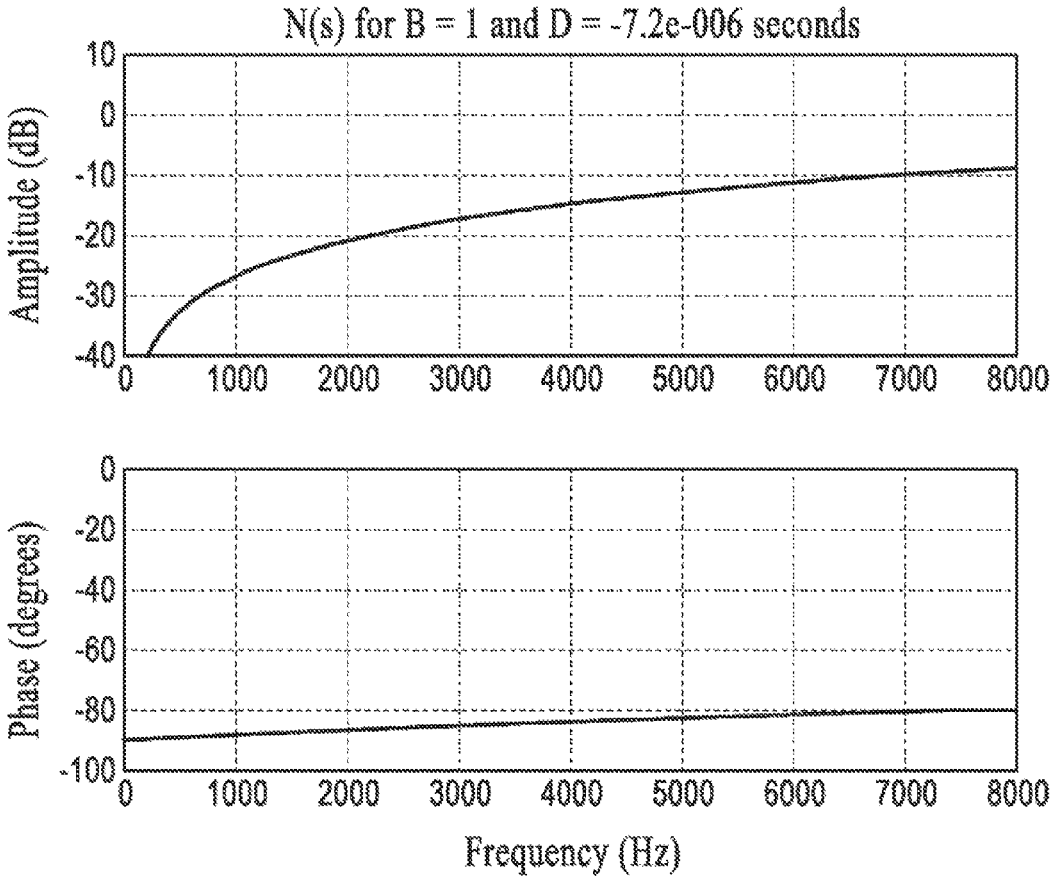
FIG. 19 is a plot of amplitude (top) and phase (bottom) response of N(s) with B=1 and D=−7.2 μsec, under an embodiment. The resulting phase difference clearly affects high frequencies more than low.

Since γ is the time difference between arrival of speech at $V_1$ compared to $V_2$, it can be errors in estimation of the angular location of the speech source with respect to the axis of the array and/or by temperature changes. Examining the temperature sensitivity, the speed of sound varies with temperature as $$c=331.3+(0.606T)\text{ m/s}$$

where T is degrees Celsius. As the temperature decreases, the speed of sound also decreases. Setting 20 C as a design temperature and a maximum expected temperature range to −40 C to +60 C (−40 F to 140 F). The design speed of sound at 20 C is 343 m/s and the slowest speed of sound will be 307 m/s at −40 C with the fastest speed of sound 362 m/s at 60 C. Set the array length ($2d_0$) to be 21 mm. For speech sources on the axis of the array, the difference in travel time for the largest change in the speed of sound is $$\begin{aligned}\nabla t_{MAX} &= \frac{d}{c_1}-\frac{d}{c_2}\\ &= 0.021\text{ m}\left(\frac{1}{343\text{ m/s}}-\frac{1}{307\text{ m/s}}\right)\\ &= -7.2\times10^{-6}\text{ sec}\end{aligned}$$

or approximately 7 microseconds. The response for N(s) given B=1 and D=7.2 μsec is shown in FIG. 19. FIG. 19 is a plot of amplitude (top) and phase (bottom) response of N(s) with B=1 and D=−7.2 μsec, under an embodiment. The resulting phase difference clearly affects high frequencies more than low. The amplitude response is less than approximately −10 dB for all frequencies less than 7 kHz and is only about −9 dB at 8 kHz. Therefore, assuming B=1, this system would likely perform well at frequencies up to approximately 8 kHz. This means that a properly compensated system would work well even up to 8 kHz in an exceptionally wide (e.g., −40 C to 80 C) temperature range. Note that the phase 10 mismatch due to the delay estimation error causes N(s) to be much larger at high frequencies compared to low.

Figure 20:
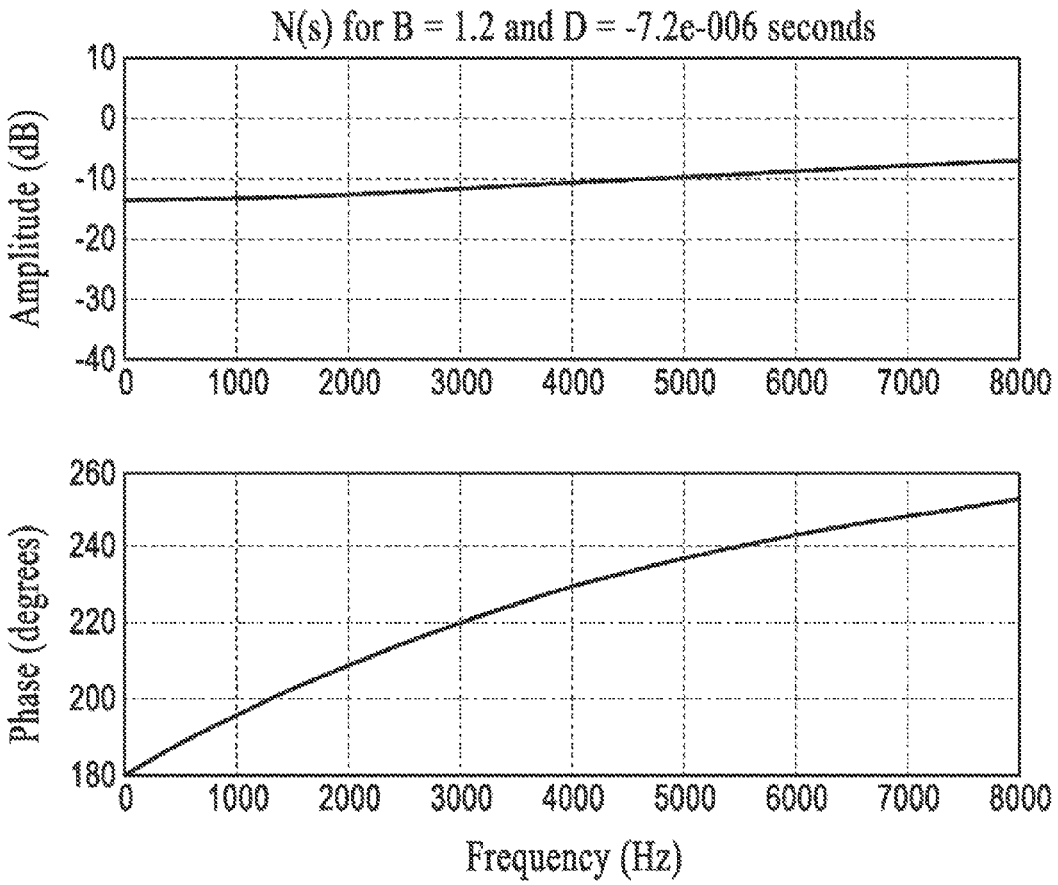
FIG. 20 is a plot of amplitude (top) and phase (bottom) response of N(s) with B=1.2 and D=−7.2 μsec, under an embodiment. Non-unity B affects the entire frequency range.

If B is not unity, the robustness of the system is reduced since the effect from non-unity B is cumulative with that of non-zero D. FIG. 20 shows the amplitude and phase response for B=1.2 and D=7.2 μsec. FIG. 20 is a plot of amplitude (top) and phase (bottom) response of N(s) with B=1.2 and D=−7.2 μsec, under an embodiment. Non-unity B affects the entire frequency range. Now N(s) is below approximately −10 dB only for frequencies less than approximately 5 kHz and the response at low frequencies is much larger. Such a system would still perform well below 5 kHz and would only suffer from slightly elevated devoicing for frequencies above 5 kHz. For ultimate performance, a temperature sensor may be integrated into the system to allow the algorithm to adjust $\gamma_T$ as the temperature varies.

Another way in which D can be non-zero is when the speech source is not where it is believed to be—specifically, the angle from the axis of the array to the speech source is incorrect. The distance to the source may be incorrect as well, but that introduces an error in B, not D.

Referring to FIG. 2, it can be seen that for two speech sources (each with their own $d_s$ and θ) that the time difference between the arrival of the speech at $O_1$ and the arrival at $O_2$ is where $$d_{11}=\sqrt{d_{S1}^2-2d_1d_0\cos(\theta_1)+d_0^2}$$

$$d_{12}=\sqrt{d_{S1}^2+2d_{S1}d_0\cos(\theta_1)+d_0^2}$$

$$d_{21}=\sqrt{d_{S2}^2-2d_{S2}d_0\cos(\theta_2)+d_0^2}$$

$$d_{22}=\sqrt{d_{S2}^2+2d_{S2}d_0\cos(\theta_2)+d_0^2}$$

Figure 21:
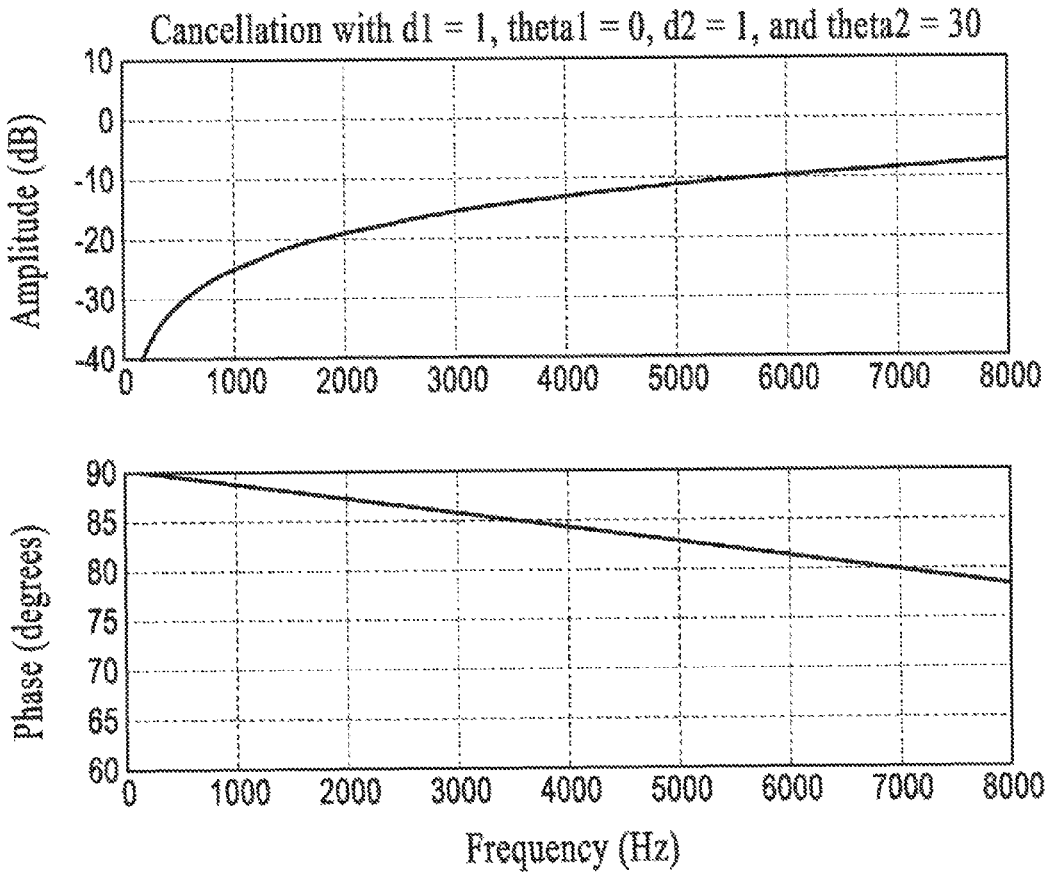
FIG. 21 is a plot of amplitude (top) and phase (bottom) response of the effect on the speech cancellation in $V_2$ due to a mistake in the location of the speech source with q1=0 degrees and q2=30 degrees, under an embodiment. The cancellation remains below −10 dB for frequencies below 6 kHz.
Figure 22:
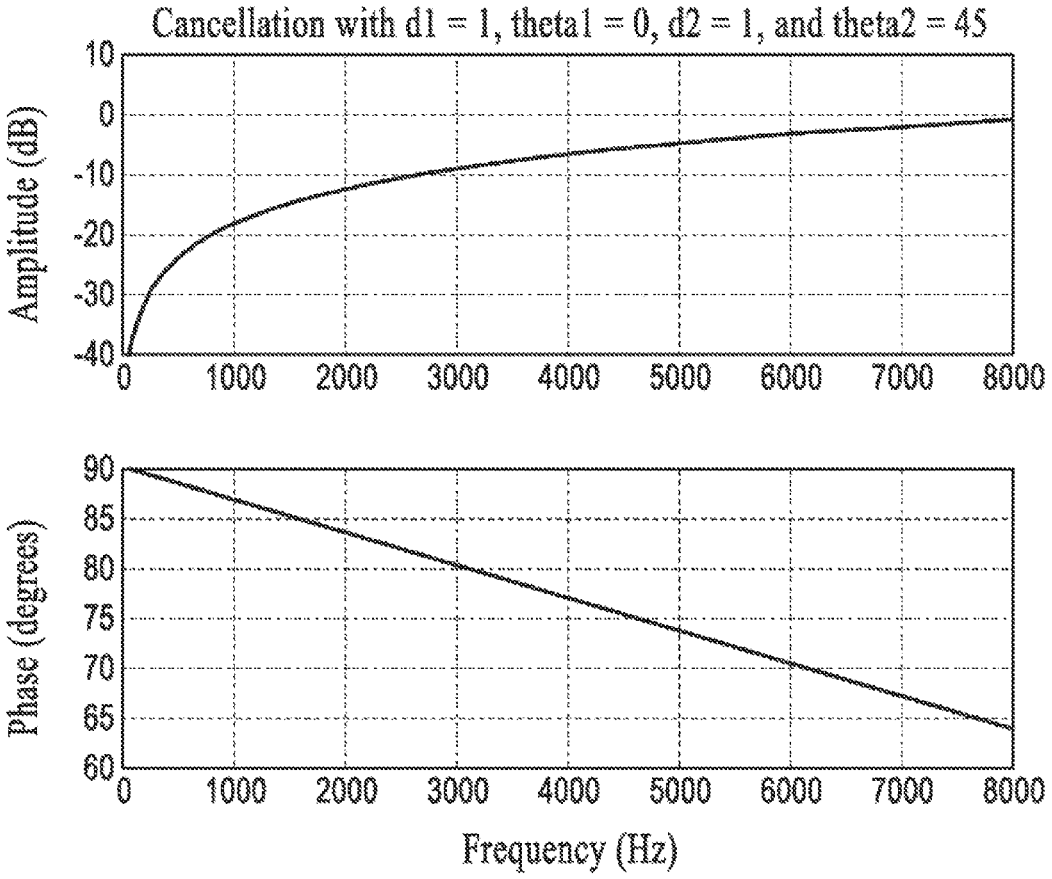
FIG. 22 is a plot of amplitude (top) and phase (bottom) response of the effect on the speech cancellation in $V_2$ due to a mistake in the location of the speech source with q1=0 degrees and q2=45 degrees, under an embodiment. The cancellation is below −10 dB only for frequencies below about 2.8 kHz and a reduction in performance is expected.

The $V_2$ speech cancellation response for $\theta_1$=0 degrees and $\theta_2$=30 degrees and assuming that B=1 is shown in FIG. 21. FIG. 21 is a plot of amplitude (top) and phase (bottom) response of the effect on the speech cancellation in $V_2$ due to a mistake in the location of the speech source with q1=0 degrees and q2=30 degrees, under an embodiment. Note that the cancellation is still below −10 dB for frequencies below 6 kHz. The cancellation is still below approximately −10 dB for frequencies below approximately 6 kHz, so an error of this type will not significantly affect the performance of the system. However, if 82 is increased to approximately 45 degrees, as shown in FIG. 22, the cancellation is below approximately −10 dB only for frequencies below approximately 2.8 kHz. FIG. 22 is a plot of amplitude (top) and phase (bottom) response of the effect on the speech cancellation in $V_2$ due to a mistake in the location of the speech source with 15 q1=0 degrees and q2=45 degrees, under an embodiment. Now the cancellation is below −10 dB only for frequencies below about 2.8 kHz and a reduction in performance is expected. The poor $V_2$ speech cancellation above approximately 4 kHz may result in significant devoicing for those frequencies.

The description above has assumed that the microphones $O_1$ and $O_2$ were calibrated so that their response to a source located the same distance away was identical for both amplitude and phase. This is not always feasible, so a more practical calibration procedure is presented below. It is not as accurate, but is much simpler to implement. Begin by defining a filter α(z) such that:

$$O_{1C}(z)=\alpha(z)O_{2C}(z)$$

where the "C" subscript indicates the use of a known calibration source. The simplest one to use is the speech of the user. Then $$O_{1S}(z)=\alpha(z)O_{2C}(z)$$

The microphone definitions are now:

$$V_1(z)=O_1(z)\cdot z^{-\gamma}-\beta(z)\alpha(z)O_2(z)$$

$$V_2(z)=\alpha(z)O_2(z)-z^{-\gamma}\beta(z)O_1(z)$$

The β of the system should be fixed and as close to the real value as possible. In practice, the system is not sensitive to changes in β and errors of approximately +−5% are easily tolerated. During times when the user is producing speech but there is little or no noise, the system can train $\alpha(z)$ to remove as much speech as possible. This is accomplished by:

1. Construct an adaptive system as shown in FIG. 1 with $\beta O_{1s}(z)z^{-Y}$ in the "MIC1" position, $O_{2S}(z)$ in the "MIC2" position, and $\alpha(z)$ in the $H_1(z)$ position.
2. During speech, adapt $\alpha(z)$ to minimize the residual of the system.
3. Construct $V_1(z)$ and $V_2(z)$ as above.

A simple adaptive filter can be used for $\alpha(z)$ so that only the relationship between the microphones is well modeled. The system of an embodiment trains only when speech is being produced by the user. A sensor like the SSM is invaluable in determining when speech is being produced in the absence of noise. If the speech source is fixed in position and will not vary significantly during use (such as when the array is on an earpiece), the adaptation should be infrequent and slow to update in order to minimize any errors introduced by noise present during training.

The above formulation works very well because the noise (far-field) responses of $V_1$ and $V_2$ are very similar while the speech (near-field) responses are very different. However, the formulations for $V_1$ and $V_2$ can be varied and still result in good performance of the system as a whole. If the definitions for $V_1$ and $V_2$ are taken from above and new variables B1 and B2 are inserted, the result is:

$$V_1(z)=O_1(z)\cdot z^{-\gamma T-B}{}_1\beta_T O_2(z)$$

$$V_2(z)=O_2(z)-z^{-\gamma TB}{}_2\beta_T O_1(z)$$

where B1 and B2 are both positive numbers or zero. If B1 and B2 are set equal to unity, the optimal system results as described above. If B1 is allowed to vary from unity, the response of $V_1$ is affected. An examination of the case where B2 is left at 1 and B1 is decreased follows. As B1 drops to approximately zero, $V_1$ becomes less and less directional, until it becomes a simple omnidirectional microphone when B1=0. Since B2=1, a speech null remains in $V_2$, so very different speech responses remain for $V_1$ and $V_2$. However, the noise responses are much less similar, so denoising will not be as effective. Practically, though, the system still performs well. B1 can also be increased from unity and once again the system will still denoise well, just not as well as with B1=1.

If B2 is allowed to vary, the speech null in $V_2$ is affected. As long as the speech null is still sufficiently deep, the system will still perform well. Practically values down to approximately B2=0.6 have shown sufficient performance, but it is recommended to set B2 close to unity for optimal performance.

Similarly, variables E and A may be introduced so that:

$$V_1(z)=(\epsilon-\beta)O_{2N}(z)+(1+\Delta)O_{1N}(z)z^{-\gamma}$$

$$V_2(z)=(1+\Delta)O_{2N}(z)+(\epsilon-\beta)O_{1N}(z)z^{-\gamma}$$

This formulation also allows the virtual microphone responses to be varied but retains the allpass characteristic of $H_1(z)$.

In conclusion, the system is flexible enough to operate well at a variety of B1 values, but B2 values should be close to unity to limit devoicing for best performance.

Figure 23:
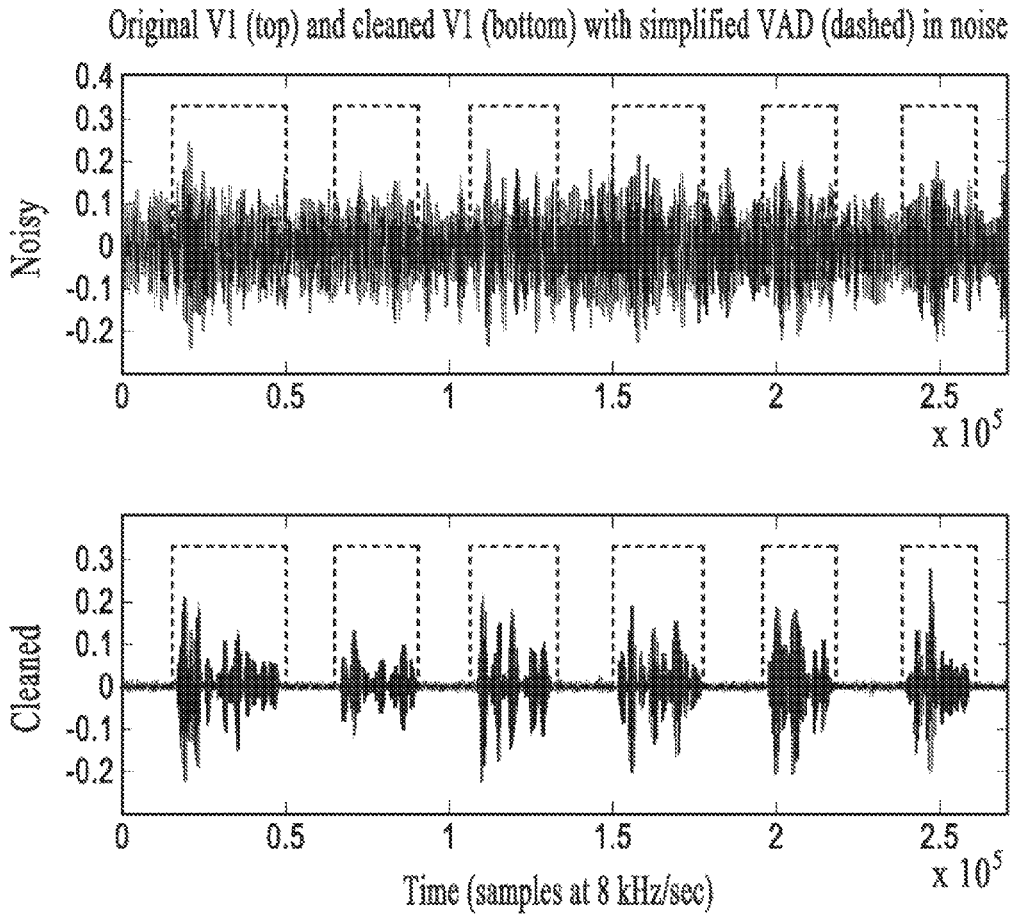
FIG. 23 shows experimental results for a $2d_0$=19 mm array using a linear β of 0.83 on a Bruel and Kjaer Head and Torso Simulator (HATS) in very loud (~85 dBA) music/speech noise environment, under an embodiment. The noise has been reduced by about 25 dB and the speech hardly affected, with no noticeable distortion.

Experimental results for a $2d_0$=19 mm array using a linear $\beta$ of 0.83 and B1=B2=1 on a Bruel and Kjaer Head and Torso Simulator (HATS) in very loud (~85 dBA) music/speech noise environment are shown in FIG. 23. The alternate 30 microphone calibration technique discussed above was used to calibrate the microphones. The noise has been reduced by about 25 dB and the speech hardly affected, with no noticeable distortion. Clearly the technique significantly increases the SNR of the original speech, far outperforming conventional noise suppression techniques.

The DOMA can be a component of a single system, multiple systems, and/or geographically separate systems. The DOMA can also be a subcomponent or subsystem of a single system, multiple systems, and/or geographically separate systems. The DOMA can be coupled to one or more other components (not shown) of a host system or a system coupled to the host system.

One or more components of the DOMA and/or a corresponding system or application to which the DOMA is coupled or connected includes and/or runs under and/or in association with a processing system. The processing system includes any collection of processor-based devices or computing devices operating together, or components of processing systems or devices, as is known in the art. For example, the processing system can include one or more of a portable computer, portable communication device operating in a communication network, and/or a network server. The portable computer can be any of a number and/or combination of devices selected from among personal computers, cellular telephones, personal digital assistants, portable computing devices, and portable communication devices, but is not so limited. The processing system can include components within a larger computer system.

The processing system of an embodiment includes at least one processor and at least one memory device or subsystem. The processing system can also include or be coupled to at least one database. The term "processor" as generally used herein refers to any logic processing unit, such as one or more central processing units (CPUs), digital signal processors (DSPs), application-specific integrated circuits (ASIC), etc. The processor and memory can be monolithically integrated onto a single chip, distributed among a number of chips or components, and/or provided by some combination of algorithms. The methods described herein can be implemented in one or more of software algorithm(s), programs, firmware, hardware, components, circuitry, in any combination.

The components of any system that includes the DOMA can be located together or in separate locations. Communication paths couple the components and include any medium for communicating or transferring files among the components. The communication paths include wireless connections, wired connections, and hybrid wireless/wired connections. The communication paths also include couplings or connections to networks including local area networks (LANs), metropolitan area networks (MANs), wide area networks (WANs), proprietary networks, interoffice or backend networks, and the Internet. Furthermore, the communication paths include removable fixed mediums like floppy disks, hard disk drives, and CD-ROM disks, as well as flash RAM, Universal Serial Bus (USB) connections, RS-232 connections, telephone lines, buses, and electronic mail messages.

Embodiments of the DOMA described herein include a microphone array comprising: a first virtual microphone comprising a first combination of a first microphone signal and a second microphone signal, wherein the first microphone signal is generated by a first physical microphone and the second microphone signal is generated by a second physical microphone; and a second virtual microphone comprising a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

The first and second physical microphones of an embodiment are omnidirectional.

The first virtual microphone of an embodiment has a first linear response to speech that is devoid of a null, wherein the speech is human speech. The second virtual microphone of an embodiment has a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The first physical microphone and the second physical microphone of an embodiment are positioned along an axis and separated by a first distance.

A midpoint of the axis of an embodiment is a second distance from a speech source that generates the speech, wherein the speech source is located in a direction defined by an angle relative to the midpoint.

The first virtual microphone of an embodiment comprises the second microphone signal subtracted from the first microphone signal.

The first microphone signal of an embodiment is delayed.

The delay of an embodiment is raised to a power that is proportional to a time difference between arrival of the speech at the first virtual microphone and arrival of the speech at the second virtual microphone.

The delay of an embodiment is raised to a power that is proportional to a sampling frequency multiplied by a quantity equal to a third distance subtracted from a fourth distance, the third distance being between the first physical microphone and the speech source and the fourth distance being between the second physical microphone and the speech source.

The second microphone signal of an embodiment is multiplied by a ratio, wherein the ratio is a ratio of a third distance to a fourth distance, the third distance being between the first physical microphone and the speech source and the fourth distance being between the second physical microphone and the speech source.

The second virtual microphone of an embodiment comprises the first microphone signal subtracted from the second microphone signal.

The first microphone signal of an embodiment is delayed.

The delay of an embodiment is raised to a power that is proportional to a time difference between arrival of the speech at the first virtual microphone and arrival of the speech at the second virtual microphone.

The power of an embodiment is proportional to a sampling frequency multiplied by a quantity equal to a third distance subtracted from a fourth distance, the third distance being between the first physical microphone and the speech source and the fourth distance being between the second physical microphone and the speech source.

The first microphone signal of an embodiment is multiplied by a ratio, wherein the ratio is a ratio of the third distance to the fourth distance.

The single null of an embodiment is located at a distance from at least one of the first physical microphone and the second physical microphone where the source of the speech is expected to be.

The first virtual microphone of an embodiment comprises the second microphone signal subtracted from a delayed version of the first microphone signal.

The second virtual microphone of an embodiment comprises a delayed version of the first microphone signal subtracted from the second microphone signal.

Embodiments of the DOMA described herein include a microphone array comprising: a first virtual microphone formed from a first combination of a first microphone signal and a second microphone signal, wherein the first microphone signal is generated by a first omnidirectional microphone and the second microphone signal is generated by a second omnidirectional microphone; and a second virtual microphone formed from a second combination of the first microphone signal and the second microphone signal, wherein the second combination is different from the first combination; wherein the first virtual microphone has a first linear response to speech that is devoid of a null, wherein the second virtual microphone has a second linear response to speech that has a single null oriented in a direction toward a source of the speech, wherein the speech is human speech.

The first virtual microphone and the second virtual microphone of an embodiment have a linear response to noise that is substantially similar.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

Embodiments of the DOMA described herein include a device comprising: a first microphone outputting a first microphone signal and a second microphone outputting a second microphone signal; and a processing component coupled to the first microphone signal and the second microphone signal, the processing component generating a virtual microphone array comprising a first virtual microphone and a second virtual microphone, wherein the first virtual microphone comprises a first combination of the first microphone signal and the second microphone signal, wherein the second virtual microphone comprises a second combination of the first microphone signal and the second microphone signal, wherein the second combination is different from the first combination, wherein the first virtual microphone and the second virtual microphone have substantially similar responses to noise and substantially dissimilar responses to speech.

Embodiments of the DOMA described herein include a device comprising: a first microphone outputting a first microphone signal and a second microphone outputting a second microphone signal, wherein the first microphone and the second microphone are omnidirectional microphones; and a virtual microphone array comprising a first virtual microphone and a second virtual microphone, wherein the first virtual microphone comprises a first combination of the first microphone signal and the second microphone signal, wherein the second virtual microphone comprises a second combination of the first microphone signal and the second microphone signal, wherein the second combination is different from the first combination, wherein the first virtual microphone and the second virtual microphone are distinct virtual directional microphones.

Embodiments of the DOMA described herein include a device comprising: a first physical microphone generating a first microphone signal; a second physical microphone generating a second microphone signal; and a processing component coupled to the first microphone signal and the second microphone signal, the processing component generating a virtual microphone array comprising a first virtual microphone and a second virtual microphone; wherein the first virtual microphone comprises the second microphone signal subtracted from a delayed version of the first microphone signal; wherein the second virtual microphone comprises a delayed version of the first microphone signal subtracted from the second microphone signal.

The first virtual microphone of an embodiment has a first linear response to speech that is devoid of a null, wherein the speech is human speech.

The second virtual microphone of an embodiment has a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The first physical microphone and the second physical microphone of an embodiment are positioned along an axis and separated by a first distance.

A midpoint of the axis of an embodiment is a second distance from a speech source that generates the speech, wherein the speech source is located in a direction defined by an angle relative to the midpoint.

One or more of the first microphone signal and the second microphone signal of an embodiment is delayed.

The delay of an embodiment is raised to a power that is proportional to a time difference between arrival of the speech at the first virtual microphone and arrival of the speech at the second virtual microphone.

The power of an embodiment is proportional to a sampling frequency multiplied by a quantity equal to a third distance subtracted from a fourth distance, the third distance being between the first physical microphone and the speech source and the fourth distance being between the second physical microphone and the speech source.

One or more of the first microphone signal and the second microphone signal of an embodiment is multiplied by a gain factor.

Embodiments of the DOMA described herein include a sensor comprising: a physical microphone array including a first physical microphone and a second physical microphone, the first physical microphone outputting a first microphone signal and the second physical microphone outputting a second microphone signal; a virtual microphone array comprising a first virtual microphone and a second virtual microphone, the first virtual microphone comprising a first combination of the first microphone signal and the second microphone signal, the second virtual microphone comprising a second combination of the first microphone signal and the second microphone signal, wherein the second combination is different from the first combination; the virtual microphone array including a single null oriented in a direction toward a source of speech of a human speaker.

The first virtual microphone of an embodiment has a first linear response to speech that is devoid of a null, wherein the second virtual microphone has a second linear response to speech that includes the single null.

The first virtual microphone and the second virtual microphone of an embodiment have a linear response to noise that is substantially similar.

The single null of an embodiment is a region of the second linear response to speech having a measured response level that is lower than the measured response level of any other region of the second linear response.

The second linear response to speech of an embodiment includes a primary lobe oriented in a direction away from the source of the speech.

The primary lobe of an embodiment is a region of the second linear response having a measured response level that is greater than the measured response level of any other region of the second linear response.

The single null of an embodiment is located at a distance from the physical microphone array where the source of the speech is expected to be.

Embodiments of the DOMA described herein include a device comprising: a headset including at least one loudspeaker, wherein the headset attaches to a region of a human head; a microphone array connected to the headset, the microphone array including a first physical microphone outputting a first microphone signal and a second physical microphone outputting a second microphone signal; and a processing component coupled to the microphone array and generating a virtual microphone array comprising a first virtual microphone and a second virtual microphone, the first virtual microphone comprising a first combination of the first microphone signal and the second microphone signal, the second virtual microphone comprising a second combination of the first microphone signal and the second microphone signal, wherein the second combination is different from the first combination, wherein the first virtual microphone and the second virtual microphone have substantially similar responses to noise and substantially dissimilar responses to speech.

The first and second physical microphones of an embodiment are omnidirectional.

The first virtual microphone of an embodiment has a first linear response to speech that is devoid of a null, wherein the speech is human speech.

The second virtual microphone of an embodiment has a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The first physical microphone and the second physical microphone of an embodiment are positioned along an axis and separated by a first distance.

A midpoint of the axis of an embodiment is a second distance from a speech source that generates the speech, wherein the speech source is located in a direction defined by an angle relative to the midpoint.

The first virtual microphone of an embodiment comprises the second microphone signal subtracted from the first microphone signal.

The first microphone signal of an embodiment is delayed.

The delay of an embodiment is raised to a power that is proportional to a time difference between arrival of the speech at the first virtual microphone and arrival of the speech at the second virtual microphone.

The delay of an embodiment is raised to a power that is proportional to a sampling frequency multiplied by a quantity equal to a third distance subtracted from a fourth distance, the third distance being between the first physical microphone and the speech source and the fourth distance being between the second physical microphone and the speech source.

The second microphone signal of an embodiment is multiplied by a ratio, wherein the ratio is a ratio of a third distance to a fourth distance, the third distance being between the first physical microphone and the speech source and the fourth distance being between the second physical microphone and the speech source.

The second virtual microphone of an embodiment comprises the first microphone signal subtracted from the second microphone signal.

The first microphone signal of an embodiment is delayed.

The delay of an embodiment is raised to a power that is proportional to a time difference between arrival of the speech at the first virtual microphone and arrival of the speech at the second virtual microphone.

The power of an embodiment is proportional to a sampling frequency multiplied by a quantity equal to a third distance subtracted from a fourth distance, the third distance being between the first physical microphone and the speech source and the fourth distance being between the second physical microphone and the speech source.

The first microphone signal of an embodiment is multiplied by a ratio, wherein the ratio is a ratio of the third distance to the fourth distance.

The first virtual microphone of an embodiment comprises the second microphone signal subtracted from a delayed version of the first microphone signal.

The second virtual microphone of an embodiment comprises a delayed version of the first microphone signal subtracted from the second microphone signal.

A speech source that generates the speech of an embodiment is a mouth of a human wearing the headset.

The device of an embodiment comprises a voice activity detector (VAD) coupled to the processing component, the VAD generating voice activity signals.

The device of an embodiment comprises an adaptive noise removal application coupled to the processing component, the adaptive noise removal application receiving signals from the first and second virtual microphones and generating an output signal, wherein the output signal is a denoised acoustic signal.

The microphone array of an embodiment receives acoustic signals including acoustic speech and acoustic noise.

The device of an embodiment comprises a communication channel coupled to the processing component, the communication channel comprising at least one of a wireless channel, a wired channel, and a hybrid wireless/wired channel.

The device of an embodiment comprises a communication device coupled to the headset via the communication channel, the communication device comprising one or more of cellular telephones, satellite telephones, portable telephones, wireline telephones, Internet telephones, wireless transceivers, wireless communication radios, personal digital assistants (PDAs), and personal computers (PCs).

Embodiments of the DOMA described herein include a device comprising: a housing; a loudspeaker connected to the housing; a first physical microphone and a second physical microphone connected to the housing, the first physical microphone outputting a first microphone signal and the second physical microphone outputting a second microphone signal, wherein the first and second physical microphones are omnidirectional; a first virtual microphone comprising a first combination of the first microphone signal and the second microphone signal; and a second virtual microphone comprising a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

Embodiments of the DOMA described herein include a device comprising: a housing including a loudspeaker, wherein the housing is portable and configured for attaching to a mobile object; and a physical microphone array connected to the headset, the physical microphone array including a first physical microphone and a second physical microphone that form a virtual microphone array comprising a first virtual microphone and a second virtual microphone; the first virtual microphone comprising a first combination of a first microphone signal and a second microphone signal, wherein the first microphone signal is generated by the first physical microphone and the second microphone signal is generated by the second physical microphone; and the second virtual microphone comprising a second combination of the first microphone signal and the second microphone signal, wherein the second combination is different from the first combination; wherein the first virtual microphone has a first linear response to speech that is devoid of a null, wherein the second virtual microphone has a second linear response to speech that has a single null oriented in a direction toward a source of the speech, wherein the speech is human speech.

The first virtual microphone and the second virtual microphone of an embodiment have a linear response to noise that is substantially similar.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

Embodiments of the DOMA described herein include a device comprising: a housing that is attached to a region of a human speaker; a loudspeaker connected to the housing; and a physical microphone array including a first physical microphone and a second physical microphone connected to the housing, the first physical microphone outputting a first microphone signal and the second physical microphone outputting a second microphone signal that in combination form a virtual microphone array; the virtual microphone array comprising a first virtual microphone and a second virtual microphone, the first virtual microphone comprising a first combination of the first microphone signal and the second microphone signal, the second virtual microphone comprising a second combination of the first microphone signal and the second microphone signal, wherein the second combination is different from the first combination; the virtual microphone array including a single null oriented in a direction toward a source of speech of the human speaker.

The first virtual microphone of an embodiment has a first linear response to speech that is devoid of a null, wherein the second virtual microphone has a second linear response to speech that includes the single null.

The first virtual microphone and the second virtual microphone of an embodiment have a linear response to noise that is substantially similar.

The single null of an embodiment is a region of the second linear response to speech having a measured response level that is lower than the measured response level of any other region of the second linear response.

The second linear response to speech of an embodiment includes a primary lobe oriented in a direction away from the source of the speech.

The primary lobe of an embodiment is a region of the second linear response having a measured response level that is greater than the measured response level of any other region of the second linear response.

The single null of an embodiment is located at a distance from the physical microphone array where the source of the speech is expected to be.

Embodiments of the DOMA described herein include a system comprising: a microphone array including a first physical microphone outputting a first microphone signal and a second physical microphone outputting a second microphone signal; a processing component coupled to the microphone array and generating a virtual microphone array comprising a first virtual microphone and a second virtual microphone, the first virtual microphone comprising a first combination of the first microphone signal and the second microphone signal, the second virtual microphone comprising a second combination of the first microphone signal and the second microphone signal, wherein the second combination is different from the first combination, wherein the first virtual microphone and the second virtual microphone have substantially similar responses to noise and substantially dissimilar responses to speech; and an adaptive noise removal application coupled to the processing component and generating denoised output signals by forming a plurality of combinations of signals output from the first virtual microphone and the second virtual microphone, wherein the denoised output signals include less acoustic noise than acoustic signals received at the microphone array.

The first and second physical microphones of an embodiment are omnidirectional.

The first virtual microphone of an embodiment has a first linear response to speech that is devoid of a null, wherein the speech is human speech.

The second virtual microphone of an embodiment has a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The first physical microphone and the second physical microphone of an embodiment are positioned along an axis and separated by a first distance.

A midpoint of the axis of an embodiment is a second distance from a speech source that generates the speech, wherein the speech source is located in a direction defined by an angle relative to the midpoint.

The first virtual microphone of an embodiment comprises the second microphone signal subtracted from the first microphone signal.

The first microphone signal of an embodiment is delayed,

The delay of an embodiment is raised to a power that is proportional to a time difference between arrival of the speech at the first virtual microphone and arrival of the speech at the second virtual microphone.

The delay of an embodiment is raised to a power that is proportional to a sampling frequency multiplied by a quantity equal to a third distance subtracted from a fourth distance, the third distance being between the first physical microphone and the speech source and the fourth distance being between the second physical microphone and the speech source.

The second microphone signal of an embodiment is multiplied by a ratio, wherein the ratio is a ratio of a third distance to a fourth distance, the third distance being between the first physical microphone and the speech source and the fourth distance being between the second physical microphone and the speech source.

The second virtual microphone of an embodiment comprises the first microphone signal subtracted from the second microphone signal.

The first microphone signal of an embodiment is delayed.

The delay of an embodiment is raised to a power that is proportional to a time difference between arrival of the speech at the first virtual microphone and arrival of the speech at the second virtual microphone.

The power of an embodiment is proportional to a sampling frequency multiplied by a quantity equal to a third distance subtracted from a fourth distance, the third distance being between the first physical microphone and the speech source and the fourth distance being between the second physical microphone and the speech source.

The first microphone signal of an embodiment is multiplied by a ratio, wherein the ratio is a ratio of the third distance to the fourth distance.

The first virtual microphone of an embodiment comprises the second microphone signal subtracted from a delayed version of the first microphone signal.

The second virtual microphone of an embodiment comprises a delayed version of the first microphone signal subtracted from the second microphone signal.

The system of an embodiment comprises a voice activity detector (VAD) coupled to the processing component, the VAD generating voice activity signals.

The system of an embodiment comprises a communication channel coupled to the processing component, the communication channel comprising at least one of a wireless channel, a wired channel, and a hybrid wireless/wired channel.

The system of an embodiment comprises a communication device coupled to the processing component via the communication channel, the communication device comprising one or more of cellular telephones, satellite telephones, portable telephones, wireline telephones, Internet telephones, wireless transceivers, wireless communication radios, personal digital assistants (PDAs), and personal computers (PCs).

Embodiments of the DOMA described herein include a system comprising: a first virtual microphone formed from a first combination of a first microphone signal and a second microphone signal, wherein the first microphone signal is generated by a first physical microphone and the second microphone signal is generated by a second physical microphone; a second virtual microphone formed from a second combination of the first microphone signal and the second microphone signal, wherein the second combination is different from the first combination; wherein the first virtual microphone has a first linear response to speech that is devoid of a null, wherein the second virtual microphone has a second linear response to speech that has a single null oriented in a direction toward a source of the speech, wherein the speech is human speech; an adaptive noise removal application coupled to the first and second virtual microphones and generating denoised output signals by forming a plurality of combinations of signals output from the first virtual microphone and the second virtual microphone, wherein the denoised output signals include less acoustic noise than acoustic signals received at the first and second physical microphones.

The first virtual microphone and the second virtual microphone of an embodiment have a linear response to noise that is substantially similar.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

Embodiments of the DOMA described herein include a system comprising: a first microphone outputting a first microphone signal and a second microphone outputting a second microphone signal, wherein the first microphone and the second microphone are omnidirectional microphones; a virtual microphone array comprising a first virtual microphone and a second virtual microphone, wherein the first virtual microphone comprises a first combination of the first microphone signal and the second microphone signal, wherein the second virtual microphone comprises a second combination of the first microphone signal and the second microphone signal, wherein the second combination is different from the first combination, wherein the first virtual microphone and the second virtual microphone are distinct virtual directional microphones; and an adaptive noise removal application coupled to the virtual microphone array and generating denoised output signals by forming a plurality of combinations of signals output from the first virtual microphone and the second virtual microphone, wherein the denoised output signals include less acoustic noise than acoustic signals received at the first microphone and the second microphone.

Embodiments of the DOMA described herein include a system comprising: a first physical microphone generating a first microphone signal; a second physical microphone generating a second microphone signal; a processing component coupled to the first microphone signal and the second microphone signal, the processing component generating a virtual microphone array comprising a first virtual microphone and a second virtual microphone; and wherein the first virtual microphone comprises the second microphone signal subtracted from a delayed version of the first microphone signal; wherein the second virtual microphone comprises a delayed version of the first microphone signal subtracted from the second microphone signal; an adaptive noise removal application coupled to the processing component and generating de noised output signals, wherein the denoised output signals include less acoustic noise than acoustic signals received at the first physical microphone and the second physical microphone.

The first virtual microphone of an embodiment has a first linear response to speech that is devoid of a null, wherein the speech is human speech.

The second virtual microphone of an embodiment has a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The first physical microphone and the second physical microphone of an embodiment are positioned along an axis and separated by a first distance.

A midpoint of the axis of an embodiment is a second distance from a speech source that generates the speech, wherein the speech source is located in a direction defined by an angle relative to the midpoint.

One or more of the first microphone signal and the second microphone signal of an embodiment is delayed.

The delay of an embodiment is raised to a power that is proportional to a time difference between arrival of the speech at the first virtual microphone and arrival of the speech at the second virtual microphone.

The power of an embodiment is proportional to a sampling frequency multiplied by a quantity equal to a third distance subtracted from a fourth distance, the third distance being between the first physical microphone and the speech source and the fourth distance being between the second physical microphone and the speech source.

One or more of the first microphone signal and the second microphone signal of an embodiment is multiplied by a gain factor.

The system of an embodiment comprises a voice activity detector (VAD) coupled to the processing component, the VAD generating voice activity signals.

The system of an embodiment comprises a communication channel coupled to the processing component, the communication channel comprising at least one of a wireless channel, a wired channel, and a hybrid wireless/wired channel.

The system of an embodiment comprises a communication device coupled to the processing component via the communication channel, the communication device comprising one or more of cellular telephones, satellite telephones, portable telephones, wireline telephones, Internet telephones, wireless transceivers, wireless 10 communication radios, personal digital assistants (PDAs), and personal computers (PCs).

Embodiments of the DOMA described herein include a system comprising: a physical microphone array including a first physical microphone and a second physical microphone, the first physical microphone outputting a first microphone signal and the second physical microphone outputting a second microphone signal; a virtual microphone array comprising a first virtual microphone and a second virtual microphone, the first virtual microphone comprising a first combination of the first microphone signal and the second microphone signal, the second virtual microphone comprising a second combination of the first microphone signal and the second microphone signal, wherein the second combination is different from the first combination; the virtual microphone array including a single null oriented in a direction toward a source of speech of a human speaker; and an adaptive noise removal application coupled to the virtual microphone array and generating denoised output signals by forming a plurality of combinations of signals output from the virtual microphone array, wherein the denoised output signals include less acoustic noise than acoustic signals received at the physical microphone array.

The first virtual microphone of an embodiment has a first linear response to speech that is devoid of a null, wherein the second virtual microphone of an embodiment has a second linear response to speech that includes the single null.

The first virtual microphone and the second virtual microphone of an embodiment have a linear response to noise that is substantially similar.

The single null of an embodiment is a region of the second linear response to speech having a measured response level that is lower than the measured response level of any other region of the second linear response. The second linear response to speech of an embodiment includes a primary lobe oriented in a direction away from the source of the speech.

The primary lobe of an embodiment is a region of the second linear response having a measured response level that is greater than the measured response level of any other region of the second linear response.

The single null of an embodiment is located at a distance from the physical microphone array where the source of the speech is expected to be.

Embodiments of the DOMA described herein include a system comprising: a first virtual microphone comprising a first combination of a first microphone signal and a second microphone signal, wherein the first microphone signal is output from a first physical microphone and the second microphone signal is output from a second physical microphone; a second virtual microphone comprising a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech; and a processing component coupled to the first and second virtual microphones, the processing component including an adaptive noise removal application receiving acoustic signals from the first virtual microphone and the second virtual microphone and generating an output signal, wherein the output Signal is a denoised acoustic signal.

Embodiments of the DOMA described herein include a method comprising: forming a first virtual microphone by generating a first combination of a first microphone signal and a second microphone signal, wherein the first microphone signal is generated by a first physical microphone and the second microphone signal is generated by a second physical microphone; and forming a second virtual microphone by generating a second combination of the first microphone signal and the second microphone Signal, wherein the second combination is different from the first combination, wherein the first virtual microphone and the second virtual microphone are distinct virtual directional microphones with substantially similar responses to noise and substantially dissimilar responses to speech.

Forming the first virtual microphone of an embodiment includes forming the first virtual microphone to have a first linear response to speech that is devoid of a null, wherein the speech is human speech.

Forming the second virtual microphone of an embodiment includes forming the second virtual microphone to have a second linear response to speech that includes a single null oriented in a direction toward a source of the speech.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The method of an embodiment comprises positioning the first physical microphone and the second physical microphone along an axis and separating the first and second physical microphones by a first distance.

A midpoint of the axis of an embodiment is a second distance from a speech source that generates the speech, wherein the speech source is located in a direction defined by an angle relative to the midpoint.

Forming the first virtual microphone of an embodiment comprises subtracting the second microphone signal subtracted from the first microphone signal.

The method of an embodiment comprises delaying the first microphone signal.

The method of an embodiment comprises raising the delay to a power that is proportional to a time difference between arrival of the speech at the first virtual microphone and arrival of the speech at the second virtual microphone.

The method of an embodiment comprises raising the delay to a power that is proportional to a sampling frequency multiplied by a quantity equal to a third distance subtracted from a fourth distance, the third distance being between the first physical microphone and the speech source and the fourth distance being between the second physical microphone and the speech source.

The method of an embodiment comprises multiplying the second microphone signal by a ratio, wherein the ratio is a ratio of a third distance to a fourth distance, the third distance being between the first physical microphone and the speech source and the fourth distance being between the second physical microphone and the speech source.

Forming the second virtual microphone of an embodiment comprises subtracting the first microphone signal from the second microphone signal.

The method of an embodiment comprises delaying the first microphone signal.

The method of an embodiment comprises raising the delay to a power that is proportional to a time difference between arrival of the speech at the first virtual microphone and arrival of the speech at the second virtual microphone.

The method of an embodiment comprises raising the delay to a power that is proportional to a sampling frequency multiplied by a quantity equal to a third distance subtracted from a fourth distance, the third distance being between the first physical microphone and the speech source and the fourth distance being between the second physical microphone and the speech source.

The method of an embodiment comprises multiplying the first microphone signal by a ratio, wherein the ratio is a ratio of the third distance to the fourth distance.

Forming the first virtual microphone of an embodiment comprises subtracting the second microphone signal from a delayed version of the first microphone signal.

Forming the second virtual microphone of an embodiment comprises: forming a quantity by delaying the first microphone signal; and subtracting the quantity from the second microphone signal.

The first and second physical microphones of an embodiment are omnidirectional.

Embodiments of the DOMA described herein include a method comprising: receiving a first microphone signal from a first omnidirectional microphone and receiving a second microphone signal from a second omnidirectional microphone; generating a first virtual directional microphone by generating a first combination of the first microphone signal and the second microphone signal; generating a second virtual directional microphone by generating a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech.

Embodiments of the DOMA described herein include a method of forming a microphone array comprising: forming a first virtual microphone by generating a first combination of a first microphone signal and a second microphone signal, wherein the first microphone signal is generated by a first omnidirectional microphone and the second microphone signal is generated by a second omnidirectional microphone; and forming a second virtual microphone by generating a second combination of the first microphone signal and the second microphone signal, wherein the second combination is different from the first combination; wherein the first virtual microphone has a first linear response to speech that is devoid of a null, wherein the second virtual microphone has a second linear response to speech that has a single null oriented in a direction toward a source of the speech, wherein the speech is human speech.

Forming the first and second virtual microphones of an embodiment comprises forming the first virtual microphone and the second virtual microphone to have a linear response to noise that is substantially similar.

The single null of an embodiment is a region of the second linear response having a measured response level that is lower than the measured response level of any other region of the second linear response.

The second linear response of an embodiment includes a primary lobe oriented in a direction away from the source of the speech. The primary lobe of an embodiment is a region of the second linear response having a measured response level that is greater than the measured response level of any other region of the second linear response.

Embodiments of the DOMA described herein include a method comprising: receiving acoustic signals at a first physical microphone and a second physical microphone; outputting in response to the acoustic signals a first microphone signal from the first physical microphone and outputting a second microphone signal from the second physical microphone; forming a first virtual microphone by generating a first combination of the first microphone signal and the second microphone signal; forming a second virtual microphone by generating a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech; generating output signals by combining signals from the first virtual microphone and the second virtual microphone, wherein the output signals include less acoustic noise than the acoustic signals.

The first and second physical microphones of an embodiment are omnidirectional microphones.

Forming the first virtual microphone of an embodiment includes forming the first virtual microphone to have a first linear response to speech that is devoid of a null, wherein the speech is human speech.

Forming the second virtual microphone of an embodiment includes forming the second virtual microphone to have a second linear response to speech that includes a single null oriented in a direction toward a source of the speech. The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

Forming the first virtual microphone of an embodiment comprises subtracting the second microphone signal from a delayed version of the first microphone signal.

Forming the second virtual microphone of an embodiment comprises: forming a quantity by delaying the first microphone signal; and subtracting the quantity from the second microphone signal. Embodiments of the DOMA described herein include a method comprising: forming a physical microphone array including a first physical microphone and a second physical microphone, the first physical microphone outputting a first microphone signal and the second physical microphone outputting a second microphone signal; and forming a virtual microphone array comprising a first virtual microphone and a second virtual microphone, the first virtual microphone 10 comprising a first combination of the first microphone signal and the second microphone signal, the second virtual microphone comprising a second combination of the first microphone signal and the second microphone signal, wherein the second combination is different from the first combination; the virtual microphone array including a single null oriented in a direction toward a source of speech of a human speaker.

Forming the first and second virtual microphones of an embodiment comprises forming the first virtual microphone and the second virtual microphone to have a linear response to noise that is substantially similar.

The single null of an embodiment is a region of the second linear response having a measured response level that is lower than the measured response level of any other region of the second linear response.

The second linear response of an embodiment includes a primary lobe oriented in a direction away from the source of the speech.

The primary lobe of an embodiment is a region of the second linear response having a measured response level that is greater than the measured response level of any other region of the second linear response.

The single null of an embodiment is located at a distance from the physical microphone array where the source of the speech is expected to be.

Aspects of the DOMA and corresponding systems and methods described herein may be implemented as functionality programmed into any of a variety of circuitry, including programmable logic devices (PLDs), such as field programmable gate arrays (FPGAs), programmable array logic (PAL) devices, electrically programmable logic and memory devices and standard cell-based devices, as well as application specific integrated circuits (ASICs). Some other possibilities for implementing aspects of the DOMA and corresponding systems and methods include: microcontrollers with memory (such as electronically erasable programmable read only memory (EEPROM)), embedded microprocessors, firmware, software, etc. Furthermore, aspects of the DOMA and corresponding systems and methods may be embodied in microprocessors having software-based circuit emulation, discrete logic (sequential and combinatorial), custom devices, fuzzy (neural) logic, quantum devices, and hybrids of any of the above device types. Of course the underlying device technologies may be provided in a variety of component types, e.g., metal-oxide semiconductor field-effect transistor (MOSFET) technologies like complementary metal-oxide semiconductor (CMOS), bipolar technologies like emitter-coupled logic (ECL), polymer technologies (e.g., silicon-conjugated polymer and metal-conjugated polymer-metal structures), mixed 15 analog and digital, etc.

It should be noted that any system, method, and/or other components disclosed herein may be described using computer aided design tools and expressed (or represented), as data and/or instructions embodied in various computer-readable media, in terms of their behavioral, register transfer, logic component, transistor, layout geometries, and/or other characteristics. Computer-readable media in which such formatted data and/or instructions may be embodied include, but are not limited to, non-volatile storage media in various forms (e.g., optical, magnetic or semiconductor storage media) and carrier waves that may be used to transfer such formatted data and/or instructions through wireless, optical, or wired signaling media or any combination thereof. Examples of transfers of such formatted data and/or instructions by carrier waves include, but are not limited to, transfers (uploads, downloads, e-mail, etc.) over the Internet and/or other computer networks via one or more data transfer protocols (e.g., HTTP, FTP, SMTP, etc.). When received within a computer system via one or more computer-readable media, such data and/or instruction-based expressions of the above described components may be processed by a processing entity (e.g., one or more processors) within the computer system in conjunction with execution of one or more other computer programs.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import, when used in this application, refer to this application as a whole and not to any particular portions of this application. When the word "or" is used in reference to a list of two or more items, that word covers all of the following interpretations of the word: any of the items in the list, all of the items in the list and any combination of the items in the list.

The above description of embodiments of the DOMA and corresponding systems and methods is not intended to be exhaustive or to limit the systems and methods to the precise forms disclosed. While specific embodiments of, and examples for, the DOMA and corresponding systems and methods are described herein for illustrative purposes, various equivalent modifications are possible within the scope of the systems and methods, as those skilled in the relevant art will recognize. The teachings of the DOMA and corresponding systems and methods provided herein can be applied to other systems and methods, not only for the systems and methods described above.

The elements and acts of the various embodiments described above can be combined to provide further embodiments. These and other changes can be made to the DOMA and corresponding systems and methods in light of the above detailed description.

In general, in the following claims, the terms used should not be construed to limit the DOMA and corresponding systems and methods to the specific embodiments disclosed in the specification and the claims, but should be construed to include all systems that operate under the claims. Accordingly, the DOMA and corresponding systems and methods is not limited by the disclosure, but instead the scope is to be determined entirely by the claims.

While certain aspects of the DOMA and corresponding systems and methods are presented below in certain claim forms, the inventors contemplate the various aspects of the DOMA and corresponding systems and methods in any number of claim forms. Accordingly, the inventors reserve the right to add additional claims after filing the application to pursue such additional claim forms for other aspects of the DOMA and corresponding systems and methods.

What is claimed is:

1. A device, comprising:

a first virtual microphone comprising a first combination of a first microphone signal and a second microphone signal, wherein the first microphone signal is generated by a first physical microphone and the second microphone signal is generated by a second physical microphone;

a second virtual microphone comprising a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech; and a signal processor coupled with the first and second microphone signals and operative to combine the first and second microphone signals by filtering and summing in the time domain, to apply a varying linear transfer function between the first and second microphone signals, and to generate an output signal having noise content that is attenuated with respect to speech content.

2. The device of claim 1, wherein the signal processor comprises one or more digital signal processors (DSPs).

3. The device of claim 1, wherein the noise content comprises acoustic noise and the speech content comprises human speech.

4. The device of claim 1, wherein the signal processor is operative to add a delay to the first microphone signals.

5. The device of claim 4, wherein the signal processor is operative to raise the delay to a power that is proportional to a time difference between arrival of the speech at the first virtual microphone and arrival of the speech at the second virtual microphone.

6. The device of claim 4, wherein the signal processor is operative to raise the delay to a power that is proportional to a sampling frequency multiplied by a quantity equal to a third distance subtracted from a fourth distance, the third distance being between the first physical microphone and a speech source of the speech and the fourth distance being between the second physical microphone and the speech source.

7. The device of claim 1, wherein the first and second physical microphones comprise omnidirectional microphones.

8. The device of claim 1, wherein the first and second physical microphones are included in a microphone array.

9. The device of claim 1, wherein the first physical microphone and the second physical microphones are disposed along an axis and are separated from each other by a first distance.

10. The device of claim 9, wherein a midpoint of the axis is a second distance from a speech source that generates the speech, wherein the speech source is located in a direction defined by an angle relative to the midpoint.

11. The device of claim 10, wherein the first virtual microphone is formed by subtracting the second microphone signal from the first microphone signal.

12. The device of claim 10, wherein the second virtual microphone is formed by subtracting the first microphone signal from the second microphone signal.

13. The device of claim 1, wherein the first virtual microphone is formed by subtracting the second microphone signal from a delayed version of the first microphone signal.

14. The device of claim 1, wherein the second virtual microphone is formed by subtracting the first microphone signal from a delayed version of the second microphone signal.

15. A device, comprising:

a first virtual microphone comprising a first combination of a first microphone signal and a second microphone signal, wherein the first microphone signal is generated by a first physical microphone and the second microphone signal is generated by a second physical microphone;

a second virtual microphone comprising a second combination of the first microphone signal and the second microphone signal, wherein the second combination is different from the first combination, wherein the first virtual microphone and the second virtual microphone are distinct virtual directional microphones with substantially similar responses to noise and substantially dissimilar responses to speech;

a virtual microphone array including the first and second virtual microphones and having a single null oriented in a direction toward a source of speech; and a signal processor coupled with the first and second microphone signals and operative to combine the first and second microphone signals by filtering and summing in the time domain, to apply a varying linear transfer function between the first and second microphone signals, and to generate an output signal having noise content that is attenuated with respect to speech content.

16. The device of claim 15, wherein the source of speech comprises human speech.

17. The device of claim 15, wherein the second virtual microphone includes a second linear response to speech and the single null comprises a region of the second linear response to speech having a measured response level that is lower than a measured response level of any other region of the second linear response to speech.

18. The device of claim 15, wherein the first virtual microphone is formed by subtracting the second microphone signal from a delayed version of the first microphone signal.

19. The device of claim 15, wherein the second virtual microphone is formed by subtracting the first microphone signal from a delayed version of the second microphone signal.

20. The device of claim 15, wherein the first and second physical microphones are included in a microphone array.

* * * * *